US008353679B2

(12) United States Patent
Yamamoto et al.

(10) Patent No.: US 8,353,679 B2
(45) Date of Patent: Jan. 15, 2013

(54) MICROPUMP DEVICE

(75) Inventors: Kazuki Yamamoto, Kyoto (JP); Masateru Fukuoka, Osaka (JP); Yoshinori Akagi, Osaka (JP); Hiroji Fukui, Kouka (JP)

(73) Assignee: Sekisui Chemical Co., Ltd., Osaka (JP)

( * ) Notice: Subject to any disclaimer, the term of this patent is extended or adjusted under 35 U.S.C. 154(b) by 397 days.

(21) Appl. No.: 12/674,514

(22) PCT Filed: Mar. 17, 2009

(86) PCT No.: PCT/JP2009/055136

§ 371 (c)(1),
(2), (4) Date: Feb. 22, 2010

(87) PCT Pub. No.: WO2009/133724

PCT Pub. Date: Nov. 5, 2009

(65) Prior Publication Data

US 2011/0129392 A1 Jun. 2, 2011

(30) Foreign Application Priority Data

Apr. 28, 2008 (JP) ..... 2008-117256
Mar. 9, 2009 (JP) ..... 2009-054876

(51) Int. Cl.
*F04B 19/24* (2006.01)

(52) U.S. Cl. ..... 417/208; 417/321

(58) Field of Classification Search ..... 417/208, 417/321

See application file for complete search history.

(56) References Cited

U.S. PATENT DOCUMENTS 5,186,001 A * 2/1993 Muntz et al. ..... 60/515
5,367,878 A * 11/1994 Muntz et al. ..... 60/512
6,322,183 B1 11/2001 Kubota et al.
6,520,613 B1 2/2003 Tamura
6,599,098 B2 * 7/2003 Weng et al. ..... 417/207

FOREIGN PATENT DOCUMENTS

EP 1992402 A1 11/2008

(Continued)

OTHER PUBLICATIONS

International Preliminary Report on Patentability for Application No. PCT/JP2009/055136 mailed Dec. 23, 2010.

(Continued)

*Primary Examiner* — Charles Freay
(74) *Attorney, Agent, or Firm* — Cheng Law Group, PLLC

(57) ABSTRACT

To provide a micropump device having good controllability over the amount of gas generated from the gas generating material and thus the amount of liquid fed by the micropump. The micropump device includes a micropump 10 and a controller 50. The micropump 10 includes: a microchannel 22 serving as a channel for liquid; a gas generating material 34 generating a gas upon exposure to light and supplying the gas to the microchannel 22; and a light source 42 for irradiating the gas generating material 34 with light 44. The controller 50 supplies to the light source 42 a control pulse signal CS that causes the light source 42 to blink on and off in a binary manner by repeating a pulse train pattern composed of a fixed number of bits each capable of having two states, one of which is a first level allowing the light source 42 to be turned on and the other of which is a second level allowing the light source 42 to be turned off.

7 Claims, 13 Drawing Sheets

FOREIGN PATENT DOCUMENTS

| | | | |
|---|---|---|---|
| JP | 9-39273 | A | 2/1997 |
| JP | 10-44411 | A | 2/1998 |
| JP | 10-193617 | A | 7/1998 |
| JP | 2005-297102 | A | 10/2005 |
| JP | 2007-279068 | A | 10/2007 |
| JP | 2007-279069 | A | 10/2007 |

OTHER PUBLICATIONS

International Search Report for the Application No. PCT/JP2009/055136 mailed May 19, 2009.

* cited by examiner

FIG. 4

| Pump Output Command Value | Bit Pattern | Degree of Irradiation Energy |
|---|---|---|
| 0 | 0000 0000 0000 0000 0000 | 0 |
| 1 | 1001 0001 0001 0001 0001 | 6 |
| 2 | 1001 0010 0100 0100 1001 | 7 |
| 3 | 1000 1100 0110 0011 0001 | 8 |
| 4 | 1001 1001 0100 1010 0101 | 9 |
| 5 | 1001 1001 0110 0110 0101 | 10 |
| 6 | 1010 1010 1101 0110 1001 | 11 |
| 7 | 1010 1101 0110 1011 0101 | 12 |
| 8 | 1101 1010 1101 0111 0101 | 13 |
| 9 | 1011 1011 0110 1110 1101 | 14 |
| 10 | 1110 1110 1110 1110 1101 | 15 |
| 11 | 1110 1111 0111 1011 1101 | 16 |
| 12 | 1111 1011 1111 0111 1101 | 17 |
| 13 | 1111 1111 0111 1111 1101 | 18 |
| 14 | 1111 1111 1111 1111 1101 | 19 |
| 15 | 1111 1111 1111 1111 1111 | 20 |

FIG. 13

(A)

| Scheduled Execution Time | Pump Number | Pump Output Command Value |
|---|---|---|
| | | |

(B)

| Scheduled Execution Time | Pump Number | Pump Output Command Value |
|---|---|---|
| 0 | 19 | 1 |
| 0 | 4 | 4 |
| 20 | 23 | 14 |
| 20 | 1 | 1 |
| 100 | 8 | 15 |
| 140 | 13 | 8 |

FIG. 14

Bit Pattern (8 bits)

| | First Digit | | | | | | | Eighth Digit |
|---|---|---|---|---|---|---|---|---|
| Pump Number 1 | 1 | 0 | 0 | 0 | 0 | 0 | 0 | 0 |
| Pump Number 2 | 0 | 1 | 0 | 0 | 0 | 0 | 0 | 0 |
| Pump Number 3 | 0 | 0 | 1 | 0 | 0 | 0 | 0 | 0 |
| Pump Number 4 | 0 | 0 | 0 | 1 | 0 | 0 | 0 | 0 |

MICROPUMP DEVICE

TECHNICAL FIELD

This invention relates to a micropump device including: a micropump for applying light to a gas generating material generating a gas upon exposure to light to allow the gas generating material to generate the gas and allowing the gas to carry a liquid, such as an analyte, a reagent or a diluted solution; and a controller for the micropump.

BACKGROUND ART

Micropumps have heretofore been proposed for applying light to a gas generating material generating a gas upon exposure to light to allow the gas generating material to generate the gas, and feeding the gas to a microchannel to allow the gas to carry a liquid in the microchannel (see, for example, Patent Documents 1 and 2).

The reason why a gas is generated from a gas generating material is, briefly, that when exposed to light, the gas generating material causes decomposition reaction (a kind of chemical reaction) and thereby generates a gas.

Patent Document 1: Published Japanese Patent Application No. 2005-297102

Patent Document 2: Published Japanese Patent Application No. 2007-279068

DISCLOSURE OF THE INVENTION

For the use of such a micropump as described above, it is important to control the amount of gas generated from the gas generating material and thus the amount of liquid fed by the micropump. However, no control means for implementing such a control is described in Patent Documents 1 and 2 mentioned above.

The following means can generally be conceived of as such control means as mentioned above:

(1) to increase and decrease the intensity of light applied to the gas generating material; and (2) to increase and decrease the irradiation time of light applied to the gas generating material.

However, these means have the following problems.

In the means (1), the decomposition rate characteristic of the gas generating material with respect to the intensity of light applied thereto is not necessarily linear, for example, like Characteristics A and C and unlike Characteristic B in FIG. 1. Therefore, it is difficult to control the amount of gas generated simply by increasing and decreasing the intensity of light applied. In other words, if the intensity of light applied is slightly increased, this may rapidly increase the decomposition rate of the gas generating material, thereby rapidly increasing the amount of gas generated. On the other hand, even if the intensity of light applied is slightly increased, it may take a long time to increase the decomposition rate of the gas generating material and thus take a long time to increase the amount of gas generated. Hence, it is difficult to control the amount of gas generated and thus control the amount of liquid fed.

In the means (2), it is difficult to provide an intermediate amount of gas generated with high accuracy simply by increasing and decreasing the light irradiation time. This is because a slight error in light irradiation time has a significant influence on the amount of gas generated. Hence, also in this case, it is difficult to control the amount of gas generated and thus control the amount of liquid fed.

With the foregoing in mind, a primary object of the present invention is to provide a micropump device having good controllability over the amount of gas generated from the gas generating material and thus the amount of liquid fed by the micropump.

An aspect of a micropump device according to the present invention includes: (a) a micropump including a microchannel serving as a channel for liquid, a gas generating material generating a gas upon exposure to light and supplying the gas to the microchannel, and a light source for irradiating the gas generating material with light; and (b) a controller for supplying a control pulse signal to the light source, the control pulse signal causing the light source to blink on and off in a binary manner by repeating a pulse train pattern composed of a fixed number of bits each capable of having two states one of which is a first level allowing the light source to be turned on and the other of which is a second level allowing the light source to be turned off.

In the micropump device, at bits of a first level in a control pulse signal supplied from the controller to the light source, the light source is turned on, so that the gas generating material initiates a decomposition reaction to generate a gas. At bits of a second level in the control pulse signal, the light source is turned off, so that the gas generating material stops the decomposition reaction to stop the gas generation. In other words, the duration of decomposition reaction of the gas generating material is determined according to the number of bits of a first level included in the control pulse signal.

Therefore, the total amount of decomposition of the gas generating material in a given period of time (hereinafter referred to as the "apparent gas generating material decomposition rate") can be controlled according to the combination of bits of a first level and bits of a second level all of which constitute each pulse train pattern in the control pulse signal. The gas generated by decomposition reaction diffuses in the gas generating material and is emitted into the microchannel. The liquid in the microchannel is transported by the volume of gas emitted into the microchannel.

By the above action, the amount of gas generated from the gas generating material and in turn the amount of liquid fed by the micropump can be controlled in a plurality of stages containing intermediate stages with high accuracy according to the combination of bits of a first level and bits of a second level all of which constitute each pulse train pattern in the control pulse signal.

In addition, since the control pulse signal causes the light source to blink on and off in a binary manner, use can be made of a fixed operating point on the decomposition rate characteristic of the gas generating material with respect to the intensity of light applied thereto. Therefore, even if the decomposition rate characteristic is not linear, the apparent gas generating material decomposition rate can be substantially linearly controlled. This results in facilitated control over the amount of gas generated and greater controllability over the amount of gas generated.

The gas generating material may be a material in which a decomposition reaction thereof initiated by exposure to light due to turning on of the light source terminates within a period of time shorter than the pulse duration of each bit in the control pulse signal after the next turning off of the light source.

The micropump device according to the present invention may include a plurality of the micropumps and may have a structure in which the controller is configured to supply a plurality of control pulse signals to respective individual light sources of the plurality of micropumps.

More specifically, for example, the controller may include: (a) a pump output command value storage section for storing a plurality of pump output command values for respective individual instructions on respective output levels of the micropumps; (b) a clock signal generation section for generating a clock signal for synchronization with serial transmission of bit data; (c) a latch signal generation section for generating a latch signal each time the periods of the clock signal are counted to the number of the micropumps; (d) a bit pattern conversion section for sequentially retrieving the pump output command values in the pump output command value storage section one by one in timed relation to the clock signal, sequentially converting the pump output command values to individual bit patterns corresponding to the respective pulse train patterns of the respective control pulse signals for the micropumps and sequentially outputting the bit patterns; (e) a bit pattern register for storing the bit pattern for one pump output command value just output from the bit pattern conversion section; (f) a bit selector for retrieving one bit of bit data from the bit pattern in the bit pattern register in timed relation to each period of the clock signal and shifting the position of the bit pattern at which one bit of bit data is to be retrieved from digit to digit according to the latch signal, thereby outputting sets of bit data as respective serial bit patterns, each set of bit data being composed of bits of the same digit in the plurality of bit patterns for the plurality of micropumps; (g) three transmission channels, one transmission channel for transmitting the serial bit patterns output from the bit selector, another transmission channel for transmitting the clock signal output from the clock signal generation section and the other transmission channel for transmitting the latch signal output from the latch signal generation section; and (h) a control pulse signal generation section that includes a shift register for taking the serial bit patterns, the clock signal and the latch signal sent via the three transmission channels, generates the respective control pulse signals for the micropumps in parallel based on the serial bit patterns, and outputs the control pulse signals in parallel. According to this configuration, the following further effects can be performed. Any type of bit pattern register will do if it can store a bit pattern for one pump output command value. Therefore, even if the number of micropumps increases, there is no need to increase the capacity of the bit pattern register. Furthermore, sets of bit data each constituting one of the respective bit patterns for the plurality of micropumps can be serially transmitted from the serial data generation section to the control pulse signal generation section. Therefore, the number of transmission channels can be reduced. In addition, no matter how much the number of micropumps increases, the necessary number of transmission channels is constant. As a result, it becomes easy to place the control pulse signal generation section near to the light sources for the plurality of micropumps and place the remaining components of the controller separately from the light sources. Therefore, the wire routing can be simplified and the flexibility of device configuration can be increased. These effects become more prominent as the number of micropumps increases. Therefore, the above configuration can easily respond to increases in the number of micropumps, which makes it easy to build a micropump device integrated on a large scale.

Another aspect of the micropump device according to the present invention includes: (a) a micropump including a microchannel serving as a channel for liquid, a gas generating chamber communicating with the microchannel, a gas generating material that is placed in the gas generating chamber and that upon exposure to light generates a gas and emits the gas from the gas generating chamber to the microchannel, and a light source for irradiating the gas generating material with light; and (b) a controller for supplying a control pulse signal to the light source, the control pulse signal causing the light source to blink on and off in a binary manner by repeating a pulse train pattern composed of a fixed number of bits each capable of having two states one of which is a first level allowing the light source to be turned on and the other of which is a second level allowing the light source to be turned off.

Still another aspect of the micropump device according to the present invention includes: (a) a micropump including a microchannel that serves as a channel for liquid, is formed in a substrate and has an opening open to a principal surface of the substrate, a gas generating material placed at the principle surface of the substrate to cover the opening of the microchannel, and a light source for irradiating a region of the gas generating material covering the opening of the microchannel with light; and (b) a controller for supplying a control pulse signal to the light source, the control pulse signal causing the light source to blink on and off in a binary manner by repeating a pulse train pattern composed of a fixed number of bits each capable of having two states one of which is a first level allowing the light source to be turned on and the other of which is a second level allowing the light source to be turned off. According to this configuration, the following further effects can be performed. Since the micropump can serve as a pump even without any gas generating chamber, the micropump can be further reduced in size and thickness. As a result, it becomes easier to build, for example, a micropump device in which a plurality of micropumps are integrated on a large scale.

In a specific aspect of the present invention, the pulse durations of the bits in the control pulse signal are equal to each other and constant, and the pulse train pattern of the control pulse signal is repeated in a predetermined cycle. According to this configuration, the following further effects can be performed. Since the control pulse signal is fixed-length pulse train patterns repeated in a predetermined cycle, the generation of a control pulse signal can be much more facilitated than when the control pulse signal is repeated pulse train patterns arbitrarily variable in length and cycle. As a result, the configuration of the controller can be simplified. These effects become more prominent as the number of micropumps increases.

In another specific aspect of the present invention, the gas generating material is a material in which a decomposition reaction thereof initiated by exposure to light due to turning on of the light source terminates within a period of time shorter than the pulse duration of each bit in the control pulse signal after the next turning off of the light source. According to this configuration, the following further effects can be performed. The decomposition reaction of the gas generating material can be stopped promptly upon turning off of the light source. This suppresses undesirable accumulation of decomposition reaction and thereby facilitates accurate realization of a desired amount of gas generated. Finally, accurate realization of a desired amount of liquid fed by the micropump can be facilitated.

In still another specific aspect of the present invention, the controller includes: a pump output command value storage section for storing a pump output command value for an instruction on an output level of the micropump; a bit pattern conversion section for converting the pump output command value in the pump output command value storage section to a bit pattern corresponding to a pulse train pattern of a control pulse signal and outputting the bit pattern; and a control pulse signal generation section for generating the control pulse signal based on the bit pattern output from the bit pattern conversion section.

In still another aspect of the present invention, the pump output command value storage section is configured so that the pump output command value stored therein can be rewritten during or before operation of the micropump. According to this configuration, the following further effect can be performed. Since the pump output command value storage section is configured so that the pump output command value stored therein can be rewritten during or before operation of the micropump, the change of the pump output command value can be immediately reflected on the output level of the micropump to immediately change the output of the micropump.

In still another aspect of the present invention, the micropump device includes a plurality of micropumps, and the controller is configured to supply a plurality of control pulse signals to respective individual light sources of the plurality of micropumps. According to this configuration, the following further effects can be performed. Since the micropump device includes a plurality of micropumps and the controller is configured to supply a plurality of control pulse signals to respective individual light sources of the plurality of micropumps, the plurality of micropumps can be individually controlled by a single controller. This makes it easy to build a micropump device including a large number of micropumps.

In still another aspect of the present invention, the controller includes: a pump output command value storage section for storing a plurality of pump output command values for respective individual instructions on respective output levels of the same plurality of micropumps; a bit pattern conversion section for converting the plurality of pump output command values in the pump output command value storage section to the same plurality of respective individual bit patterns corresponding to respective pulse train patterns of respective control pulse signals for the micropumps and outputting the plurality of bit patterns; and a control pulse signal generation section for generating the respective control pulse signals for the micropumps based on the bit patterns output from the bit pattern conversion section and outputting the control pulse signals in parallel.

In still another aspect of the present invention, the controller includes: a pump output command value storage section for storing a plurality of pump output command values for respective individual instructions on respective output levels of the same plurality of micropumps; a bit pattern conversion section for converting the plurality of pump output command values in the pump output command value storage section to the same plurality of respective individual bit patterns corresponding to respective pulse train patterns of respective control pulse signals for the micropumps and outputting the plurality of bit patterns; a serial data generation section for serially outputting sets of bit data, each set of bit data constituting one of the respective bit patterns for the micropumps output from the bit pattern conversion section; and a control pulse signal generation section for generating the respective control pulse signals for the micropumps in parallel based on the sets of bit data output from the serial data generation section and outputting the control pulse signals in parallel. According to this configuration, the following further effects can be performed. Sets of bit data each constituting one of the respective bit patterns for the plurality of micropumps can be serially transmitted from the serial data generation section to the control pulse signal generation section. Therefore, the number of transmission channels can be reduced. In addition, no matter how much the number of micropumps increases, the necessary number of transmission channels is constant. As a result, it becomes easy to place the control pulse signal generation section near to the light sources for the plurality of micropumps and place the remaining components of the controller separately from the light sources. Therefore, the wire routing can be simplified and the flexibility of device configuration can be increased. These effects become more prominent as the number of micropumps increases. Therefore, the above configuration can easily respond to increases in the number of micropumps, which makes it easy to build a micropump device integrated on a large scale.

In still another specific aspect of the present invention, the controller further includes a command interpreter for interpreting a command sequence given from the outside and rewriting the plurality of pump output command values in the pump output command value storage section during or before operation of the micropumps. According to this configuration, the following further effects can be performed. Since the controller includes the command interpreter as described above, the operations and outputs of the individual micropumps can be dynamically controlled at arbitrary timings by a command sequence given from the outside. Therefore, the control over each micropump is made more flexible and easier.

In still another specific aspect of the present invention, the controller includes: a command interpreter for interpreting a command sequence given from the outside and generating a plurality of pieces of event information each formed of a set of a pump number, a pump output command value and a scheduled execution time; an event information storage section for storing the plurality of pieces of event information; a timer for counting the time; a prefetch section for retrieving the plurality of pieces of event information from the event information storage section prior to execution of the pieces of event information; and an event management section for comparing the scheduled execution times in the pieces of event information retrieved into the prefetch section with the time of the timer and, if there is a piece of event information the scheduled execution time for which has come, giving the pump output command value for the pump number in that piece of event information to the pump output command value storage section to rewrite the pump output command value for the corresponding pump number in the pump output command value storage section. According to this configuration, the following further effects can be performed. Since the controller includes the command interpreter, the event information storage section, the event management section and so on as described above, the pieces of event information based on the command sequence given from the outside can be previously stored and the individual micropumps can be controlled at their respective scheduled execution times. In other words, the individual micropumps can be controlled outside the control of the external device, so to say, autonomously. In addition, since the controller stores pieces of event information based on a command sequence given from the outside, there is no need to always give a command sequence to the controller, which removes any limitation on the command sequence in terms of communication speed. As a result, the controller can respond to a micropump device integrated on a larger scale.

Examples of applicable more specific configurations of the controller include various configurations other than the above.

EFFECTS OF THE INVENTION

According to the present invention, the control pulse signal supplied from the controller to the light source causes the light source to blink on and off in a binary manner, and use can be thereby made of a fixed operating point on the decomposition rate characteristic of the gas generating material with respect to the intensity of light applied thereto. This results in greater controllability over the amount of gas generated from the gas generating material and in turn greater controllability over the amount of liquid fed by the micropump.

In addition, the amount of gas generated from the gas generating material and in turn the amount of liquid fed by the micropump can be controlled in a plurality of stages containing intermediate stages with high accuracy according to the combination of bits of a first level and bits of a second level all of which constitute each pulse train pattern in the control pulse signal. Therefore, also in this point of view, good controllability is provided.

BRIEF DESCRIPTION OF THE DRAWINGS

FIG. 4 is a diagram showing an example of correspondences between pump output command values, bit patterns and degrees of irradiation energy.

FIG. 13 is a diagram showing (A) an example of a configuration of a piece of event information and (B) an example of an event information sequence formed of a plurality of pieces of event information.

FIG. 14 is a diagram in which a plurality of bit patterns are conveniently arranged to align their digit positions.

LIST OF REFERENCE NUMERALS

Figure 1:
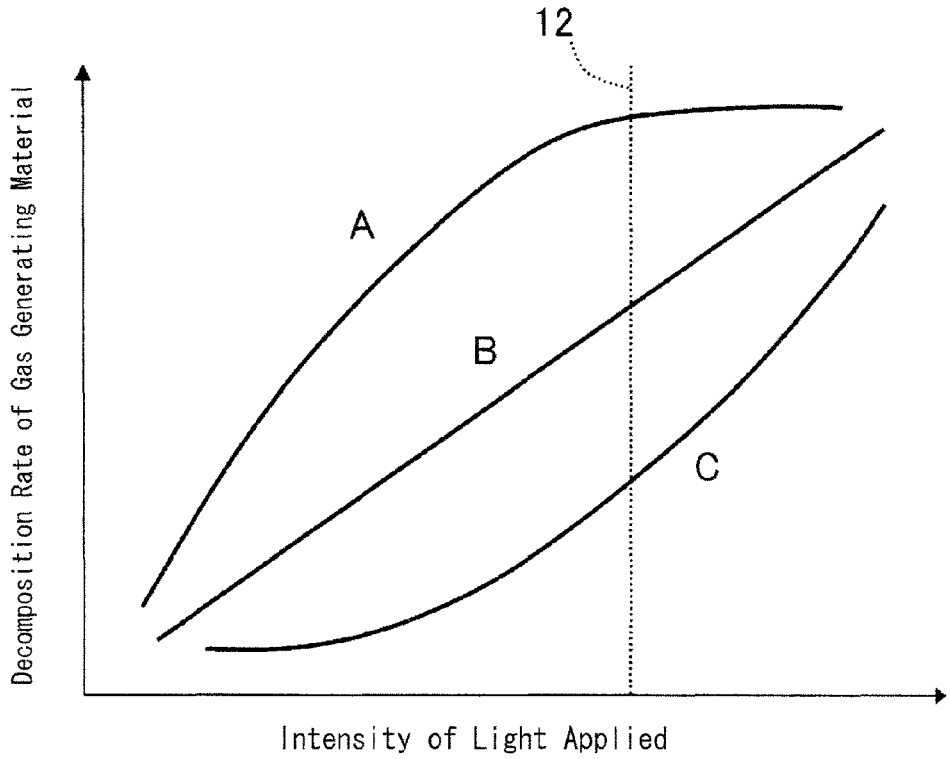
FIG. 1 is a graph showing schematic examples of the decomposition rate characteristic of a gas generating material with respect to the intensity of light applied thereto.

10 micropump
20 channel substrate
21 substrate
22 microchannel
25 opening
30 pump substrate
32 gas generating chamber
34 gas generating material
40 light source substrate
42 light source
44 light
50 controller
52 pump output command value storage section
52*a* pump output command value storage section
54, 54*a*, 54*b* bit pattern conversion section
56, 56*a*, 56*b*, 56*c* control pulse signal generation section
58 serial data generation section
64-67 transmission channel
70 cyclic selector
71 conversion section
72 bit pattern register
74 bit selector
76 clock signal generation section
78 latch signal generation section
80 external device
86, 86*a* command interpreter
88 event information storage section
90 timer
92 prefetch section
94 event management section
CS control pulse signal
PP pulse train pattern
SB serial bit pattern
CLK clock signal
LCH latch signal
COM command sequence

BEST MODE FOR CARRYING OUT THE INVENTION

(1) First Embodiment

Figure 2:
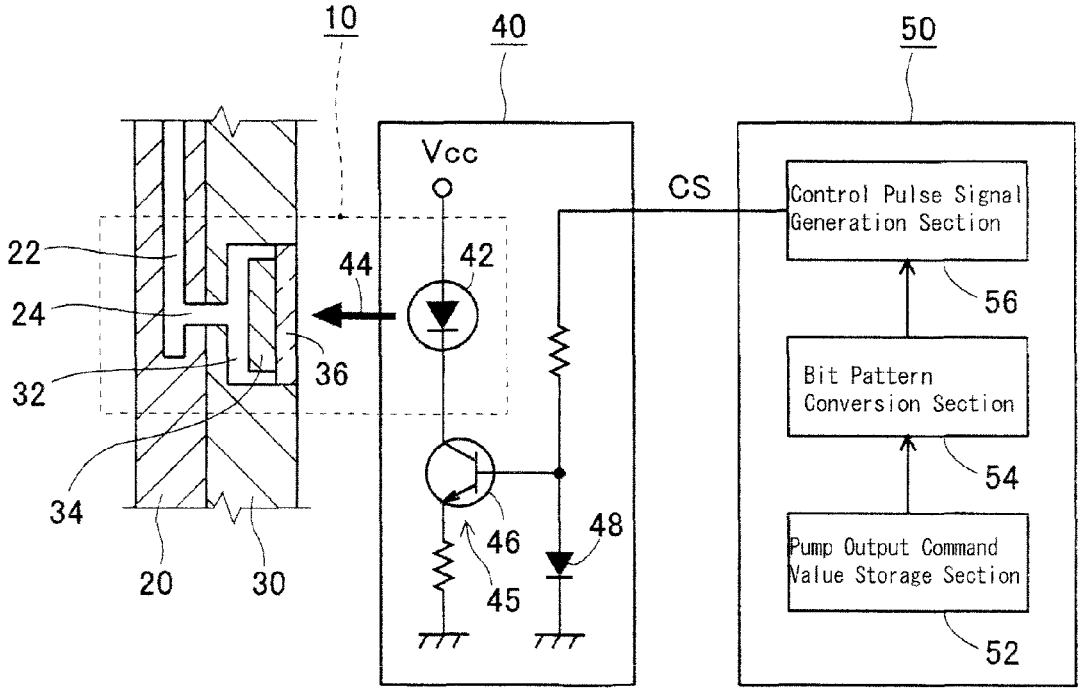
FIG. 2 is a diagram showing an embodiment of a micropump device according to the present invention.

FIG. 2 is a diagram showing an embodiment of a micropump device according to the present invention.

The micropump device includes a micropump 10 that includes: a microchannel 22 serving as a channel for liquid; a gas generating material 34 generating a gas upon exposure to light and supplying the gas to the microchannel 22; and a light source 42 for irradiating the gas generating material 34 with light 44. The micropump device further includes a controller 50 for supplying to the light source 42 of the micropump 10 a control pulse signal CS that causes the light source 42 to blink on and off in a binary manner (i.e., turns the light source 42 on and off).

The micropump 10 can feed to the microchannel 22 the gas generated from the gas generating material 34, thereby transporting the liquid in the microchannel 22 by the volume of the gas fed. Thus, the micropump 10 functions as a pump.

In this embodiment, the micropump 10 further includes a gas generating chamber 32 communicating with the microchannel 22. The gas generating material 34 is placed in the gas generating chamber 32. Therefore, the gas generating material 34 emits the gas generated upon exposure to light 44 from the gas generating chamber 32 to the microchannel 22.

Figure 3:
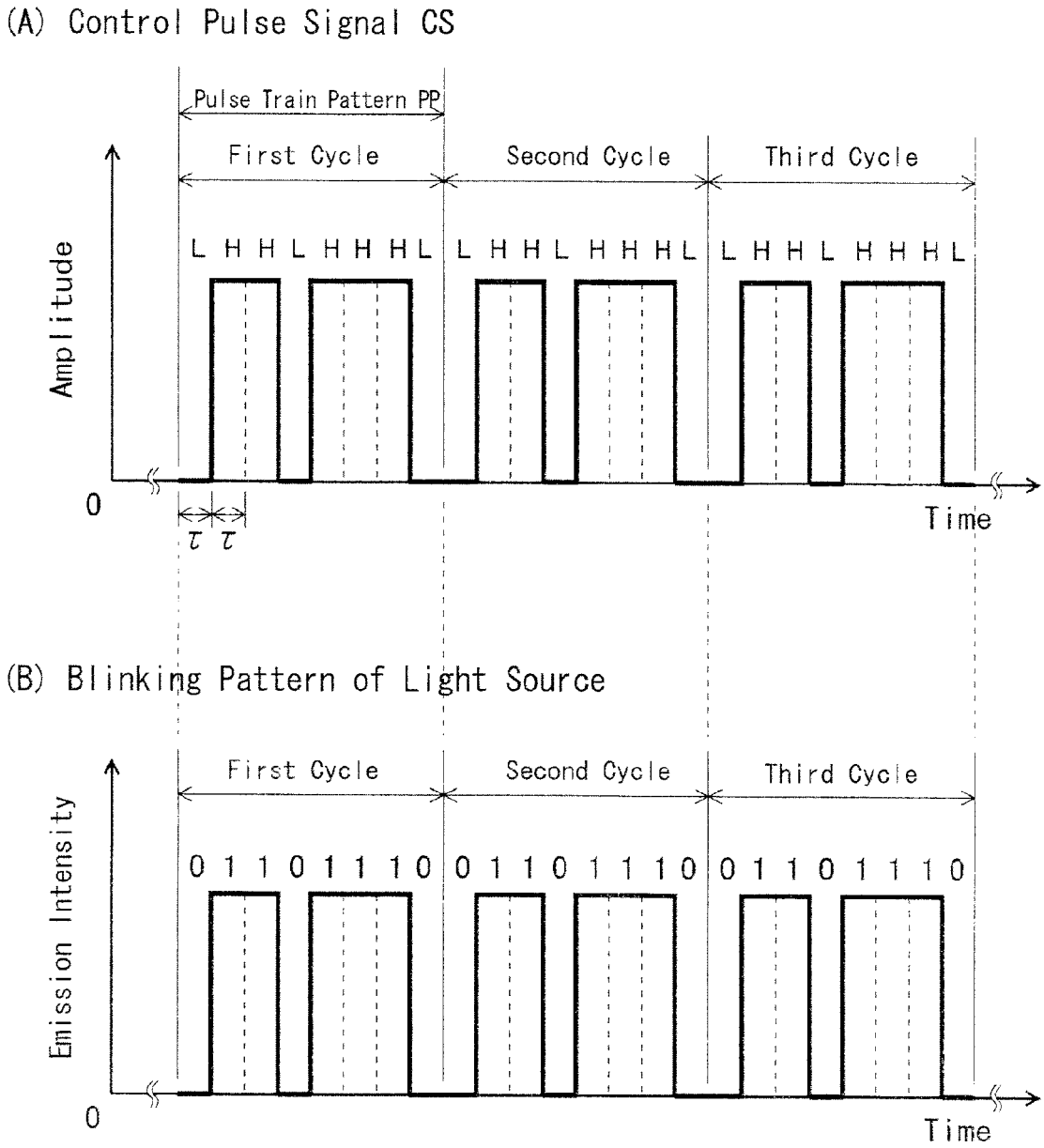
FIG. 3 is graphs showing an example of a control pulse signal and an example of a blinking pattern of a light source.

An example of a control pulse signal CS supplied from the controller 50 to the light source 42 is shown in FIG. 3. A control pulse signal CS is, as shown in FIG. 3A, repeated pulse train patterns PP each composed of a fixed number of bits (8 bits in the example of FIG. 3) each capable of having two states one of which is a first substantially fixed level (for example, a high level) H allowing the light source 42 to be turned on and the other of which is a second substantially fixed level (for example, a zero level or low level) L allowing the light source 42 to be turned off, whereby the light source 42 is blinked on and off in a binary manner as shown in FIG. 3B. Therefore, the control pulse signal CS and the blinking pattern of the light source 42 are synchronized with each other, and have the same pattern. Note that "1" in FIG. 3B indicates an on state, and "0" indicates an off state (the same applies to FIGS. 6 and 7)

The duration τ of each pulse of the control pulse signal CS is, for example, 10 ms (milliseconds). Therefore, the light source 42 repeats blinking at high speeds.

The configuration of the controller 50 will be described later. Before that, the structure of the micropump 10 will now be described in detail.

As shown in FIG. 2, in this embodiment, the microchannel 22 forming part of the micropump 10 is formed in a channel substrate 20, while the gas generating chamber 32 forming another part thereof is formed in a pump substrate 30. Both the substrates 20 and 30 are bonded to each other, for example, by thermal fusion bonding or through an unshown adhesive layer. However, the microchannel 33 and the gas generating chamber 32 may be formed in the same substrate.

The microchannel 22 is a minute channel having a width of, for example, about 50 μm to 2 mm. The structure, length and other features of the microchannel 22 are arbitrary. For example, only a single microchannel 22 may exist or the microchannel 22 may be branched into plural subchannels or may communicate with another microchannel 22 or the like.

An unshown liquid flows through the microchannel 22. The liquid is, for example, water, oil, biochemical buffer liquid, blood, lymph, urine, water extracted from soil, hydroponic water or the like. Since the microchannel 22 is minute as described above, the liquid is, for example, liquid drops.

The microchannel 22 has a communicating part 24 communicating with the gas generating chamber 32. The communicating part 24 is formed of, for example, one or more minute channels having a width of about 0.2 μm to 20 μm, a porous material having a maximum pore diameter of about 5 μm, or a water-repellent channel having a width of about 50 μm or less.

The size of the gas generating chamber 32 is, for example, a total volume of about 1 $cm^3$ or less. The gas generating chamber 32 may be formed of, for example, a single cylindrical space or polyhedral space or an assembly of a plurality of short branched channels. The internal wall of the gas generating chamber 32 may be provided with pillar-shaped, groove-shaped, grid-shaped or other suitably shaped irregularities.

The gas generating material 34 is, for example, a material in which a compound generating a gas upon exposure to light is dispersed in or compatibly blended with a binder resin. The compound generating a gas upon exposure to light acts to generate a gas when irradiated with light. The binder resin acts to immobilize the compound generating a gas upon exposure to light or add various functions to the gas generating material.

The compound generating a gas upon exposure to light is not particularly limited so long as it generates a gas upon exposure to light 44 from the light source 42.

Examples of the compound generating a gas upon exposure to light include a compound (A) generating a gas by photo-decomposition reaction, a mixture (B) of a photoacid generator and an acid-activated gas forming agent, and a mixture (C) of a photobase generator and a base proliferator. More specific examples of these compounds will be later described in detail.

There are various possible manners of placing the gas generating material 34 in the gas generating chamber 32. For example, as shown in FIG. 2, a light-transmissive plate 36 covering the gas generating chamber 32 may be provided with the gas generating material 34 attached to the inside surface of the light-transmissive plate 36.

The light-transmissive plate 36 can transmit light 44 and is made of, for example, (meth)acrylic resin, polyethylene terephthalate (abbreviated as PET), cycloolefin copolymer (abbreviated as COP) or glass. The pump substrate 30 may be formed of a light-transmissive substrate and formed integrally with the light-transmissive plate 36.

Alternatively, the gas generating material 34 may be placed as a tablet in the gas generating chamber 32 or may be applied or attached to the internal wall of the gas generating chamber 32. A piece of nonwoven fabric, a piece of woven fabric or any other porous material impregnated with the gas generating material 34 may be fitted in the gas generating chamber 32. A material forming a wall surface of the gas generating chamber 32 may serve also as a gas generating material 34.

Various types of light sources 42 are applicable. The light source 42 may be directly controlled by a control pulse signal CS or may be controlled via a light-source control circuit (see a light-source control circuit 45 as described hereinafter) or the like. The choice of which control manner to use may be determined depending upon the characteristics or the like of the light source 42.

Any wavelength of light 44 emitted from the light source 42 may be employed as long as it enables the gas generating material 34 to cause decomposition reaction (i.e., gas generation reaction) and, therefore, the wavelength is not limited to a particular wavelength. The light 44 may be ultraviolet light or near-ultraviolet light. The light 44 may have a single wavelength or a wide emission bandwidth. Particularly preferable is light having an emission band which exists around a wavelength suitable for inducing decomposition reaction of the gas generating material 34 and the half-width of which is about 10 nm. Such light provides good efficiency.

In this embodiment, the light source 42 is a light-emitting diode (abbreviated as LED) and is disposed on a light source substrate 40. A light-source control circuit 45 including a transistor 46, a diode 48 and other components is also disposed on the light source substrate 40. The light source substrate 40 is disposed substantially opposite to the pump substrate 30. An optical system, such as a lens or an optical waveguide, may be interposed between the light source substrate 40 and the pump substrate 30.

The light source 42 is controlled through the light-source control circuit 45 by a control pulse signal CS to repeat blinking in a binary manner and at high speeds. More specifically, when the control pulse signal CS is at a first level H, a forward current flows through the diode 48 to produce a substantially constant forward voltage across both ends of the diode 48. The forward voltage turns on the transistor 46, whereby a substantially constant current flows from a power supply Vcc into the light source 42, and thus the light source 42 emits light with a substantially constant intensity. When the control pulse signal CS is at a second level L, the transistor 46 is turned off, whereby the light source 42 is also turned off. These actions are repeated. Thus, as described above, the light source 42 repeats blinking in the same pattern as the control pulse signal CS.

The light-source control circuit 45 is provided as necessary depending upon the characteristics or the like of the light source 42 as described above, and forms part of the light source 42 in terms of function.

The power supply Vcc is preferably controlled to produce a constant current, and if so, the emission intensity of the light source 42 can be brought closer to a constant value. To elevate the voltage applied to the base of the transistor 46, a plurality of diodes 48 may be connected in series with each other.

LEDs have the advantages of high response speed, high efficiency, low power consumption, less heat dissipation, small size and the possibility of being densely packed, and is therefore suitable for the light source 42.

More specifically, for example, an ultraviolet LED capable of emitting light 44 from ultraviolet to violet in a wavelength range from about 330 nm to 410 nm and having an optical power of about 10 mW to 400 mW may be selected as an LED for the light source 42. The light 44 having such characteristics elevates the temperature of the gas generating material 34 very little.

The light source 42 is not limited to LEDs and may be any type of light source so long as it can repeat blinking. For example, the light source 42 may be an electroluminescence device (abbreviated as EL device), a plasma emission device or the like. Alternatively, usable light sources 42 include (a) a continuous-emission light source, such as an external electrode fluorescent lamp (EEFL) or a micro halogen lamp, whose extracted light can be blinked on and off in a combination with an optical shutter, and (b) a continuous-emission light source whose extracted light can be blinked on and off in a combination with an optical fiber and an optical selector. The optical shutter and the optical selector may be controlled by a control pulse signal CS.

Next, the controller 50 will be described.

In the embodiment shown in FIG. 2, the controller 50 includes: a pump output command value storage section 52 for storing a pump output command value for an instruction on an output level of the micropump 10; a bit pattern conversion section 54 for converting the pump output command value in the pump output command value storage section 52 to a bit pattern corresponding to a pulse train pattern PP of a control pulse signal CS and outputting the bit pattern; and a control pulse signal generation section 56 for generating the control pulse signal CS based on the bit pattern output from the bit pattern conversion section 54. The control pulse signal generation section 56 includes a storage means (for example, a memory, a register or the like) for storing the bit pattern having been supplied from the bit pattern conversion section 54.

FIG. 4 shows an example of correspondences between pump output command values, bit patterns and degrees of irradiation energy of light 44. FIG. 3 shows, for simplicity, an example in which the pulse train pattern PP is composed of 8 bits. However, in the example of FIG. 4, each bit pattern is composed of 20 bits, and therefore the corresponding pulse train pattern PP is also composed of 20 bits. More specifically, a bit having a logical value "1" in each bit pattern corresponds to a bit of a first level H in the corresponding pulse train pattern PP, while a bit having a logical value "0" in the bit pattern corresponds to a bit of a second level L in the pulse train pattern PP. In other words, the pulse train pattern PP has a structure in which the value "1" in the bit pattern is replaced with H and the value "0" is replaced with L.

The pump output command value is used for the purpose of instructing the micropump 10 to produce power at one of a plurality of output levels (stages) from zero to maximum. In the example shown in FIG. 4, the output of the micropump 10 is divided into 16 stages from 0 to 15.

Each of the pump output command values is converted to a corresponding bit pattern by the bit pattern conversion section 54, the bit pattern is converted to a corresponding pulse train pattern PP by the control pulse signal generation section 56, and the pulse train pattern PP is repeatedly output by the control pulse signal generation section 56, whereby a control pulse signal CS is generated. The control pulse signal CS is supplied to the light source 42 to blink the light source 42 on and off as described above, thereby providing a corresponding degree of irradiation energy of light 44 to be applied to the gas generating material 34.

More specifically, each bit pattern corresponds to one of the pump output command values, and as the pump output command value increases, the number of bits having a logical value "1" in a bit pattern increases. The control pulse signal generation section 56 converts each of the values "1" in the bit pattern to a pulse of a first level H with a predetermined pulse duration $\tau$ (see FIG. 3), converts each of the values "0" in the bit pattern to a pulse of a second level L with a predetermined pulse duration $\tau$ to generate a pulse train pattern PP, and repeatedly outputs the pulse train pattern PP, thereby generating and outputting a control pulse signal CS.

In this embodiment, the pulse durations $\tau$ of bits in the control pulse signal CS are equal to each other and constant, and the pulse train pattern PP is repeated in a predetermined cycle. In other words, the control pulse signal CS is fixed-length pulse train patterns PP repeated in a predetermined cycle. The pulse duration $\tau$ is, for example, 10 ms. Therefore, the light source 42 repeats blinking at high speeds. However, the pulse duration $\tau$ is not limited to 10 ms and may be shorter or longer than 10 ms. For example, the pulse duration $\tau$ may be about 100 ms.

The irradiation energy is irradiation energy per unit time. The dimension of the unit is $W/m^2$, but in this embodiment, is $mW/cm^2$ (see also FIG. 5)

Figure 5:
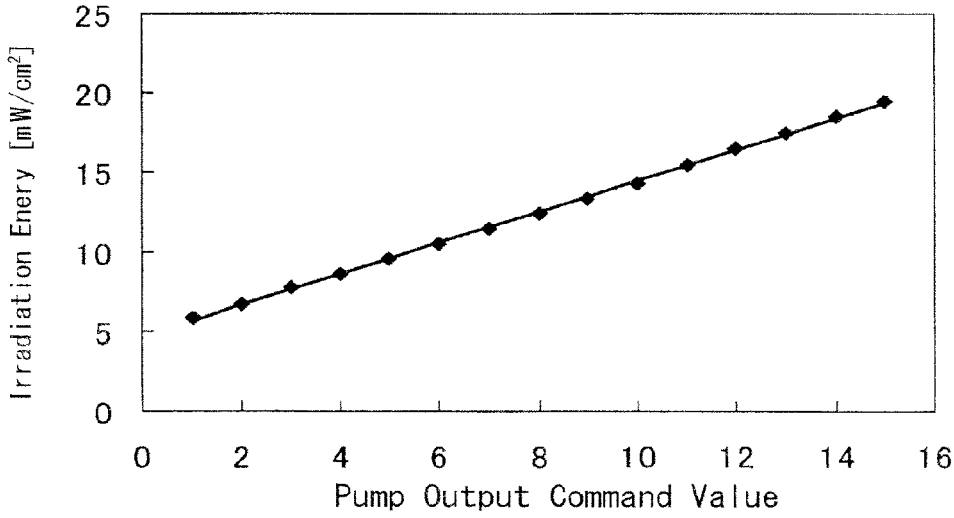
FIG. 5 is graphs showing an example of measurement results of control characteristics of a micropump.
Figure 5:
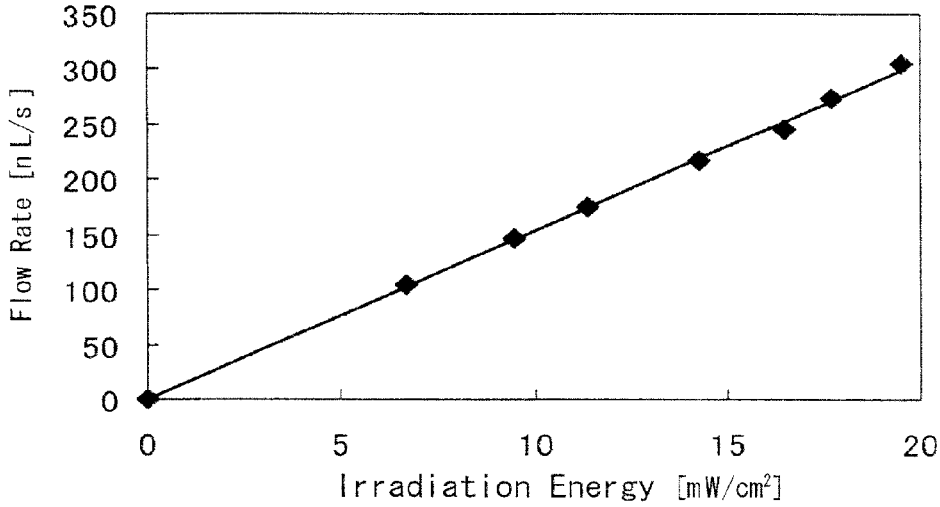
Figure 5:
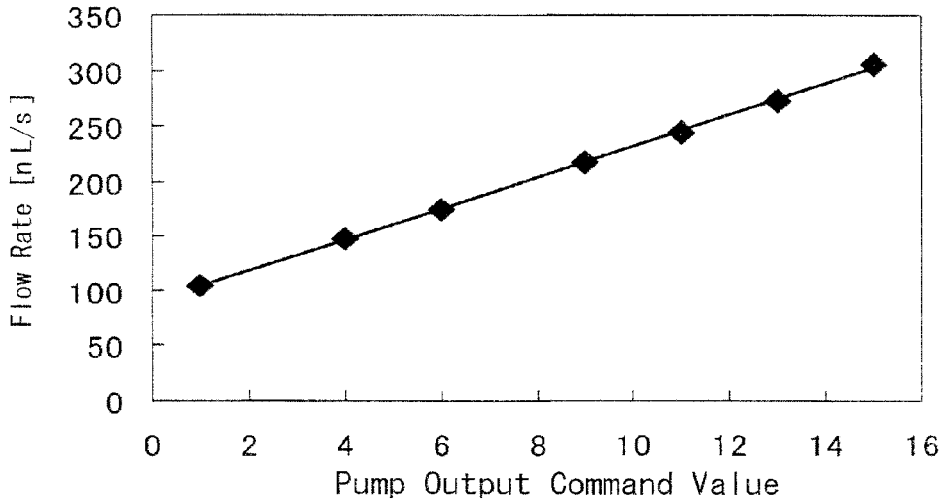

The pump output command value, the irradiation energy and the output of the micropump 10 (i.e., the flow rate or the amount of liquid fed) have substantially pre-determined correspondences with each other according to the characteristics or the like of the light source 42 and the gas generating material as seen from the example shown in FIG. 5. Each of the correspondences is not necessarily linear. Any substantially pre-determined correspondence will do. Using these correspondences, a desired flow rate can be provided according to the pump output command value.

The number of bits in the bit pattern and pulse train pattern PP is not limited to 8 and 20 bits, and may be any number of bits other than those in the above examples so long as it is a fixed number of bits more than one. For example, the number of bits may be 4, 16 or 32 bits. As the number of bits is larger, the amount of gas generated from the gas generating material 34 and in turn the amount of liquid fed by the micropump 10 can be controlled in a larger number of stages.

All or part of the controller 50 may be implemented, for example, by a microcomputer or a personal computer. The same applies to controllers 50 in other embodiments described hereinafter.

In the micropump device of this embodiment, at bits of a first level H in a control pulse signal CS supplied from the controller 50 to the light source 42, the light source 42 is turned on, so that the gas generating material 34 initiates a decomposition reaction to generate a gas. At bits of a second level L in the control pulse signal CS, the light source 42 is turned off, so that the gas generating material 34 stops the decomposition reaction to stop the gas generation. In other words, the duration of decomposition reaction of the gas generating material 34 is determined according to the number of bits of a first level H included in the control pulse signal CS.

Therefore, the total amount of decomposition of the gas generating material 34 in a given period of time, i.e., the above-mentioned apparent gas generating material decomposition rate, can be controlled according to the combination of bits of a first level H and bits of a second level L all of which constitute each pulse train pattern PP in the control pulse signal CS. The gas generated by decomposition reaction diffuses in the gas generating material 34 and is emitted into the microchannel 22 as described previously. The liquid in the microchannel 22 is transported by the volume of gas emitted into the microchannel 22.

By the above action, the amount of gas generated from the gas generating material 34 and in turn the amount of liquid fed by the micropump 10 can be controlled in a plurality of stages containing intermediate stages with high accuracy according to the combination of bits of a first level H and bits of a second level L all of which constitute each pulse train pattern PP in the control pulse signal CS.

In addition, since the control pulse signal CS causes the light source 42 to blink on and off in a binary manner, use can be made of a fixed operating point on the previously described decomposition rate characteristic (see FIG. 1) of the gas generating material 34 with respect to the intensity of light applied thereto. For example, use can be made of an operating point at the intersection point between the characteristic curve and the line 12 in FIG. 1. Therefore, even if the decomposition rate characteristic is not linear, the apparent gas generating material decomposition rate can be substantially linearly controlled. This results in facilitated control over the amount of gas generated and greater controllability over the amount of gas generated.

The bit pattern may be configured so that four or more bits of "0" do not continue except when the pump output command value is "0", i.e., except when the output of the micropump 10 is desired to be zero. In terms of pulse train pattern PP, it may be configured so that four or more bits of a second level L do not continue except when the output of the micropump 10 is desired to be zero. Then, ripples of gas generated from the gas generating material 34 can be reduced.

FIG. 5 shows an example of measurement results of characteristics when the micropump 10 (more specifically, its light source 42) was controlled by control pulse signals CS generated based on the bit patterns shown in FIG. 4.

The micropump 10 used for this measurement is a micropump having a structure in which a gas generating material 34 using a compound (A) capable of generating a gas by photodecomposition reaction is placed in a gas generating chamber 32 with a diameter of 8 mm and a depth of 2 mm. The light source 42 used is an ultraviolet LED with a peak wavelength of 365 nm, an optical power of 100 mW and a directionality of 100 degrees.

Each degree of irradiation energy of light 44 emitted from the light source 42 is a value measured with an optical power meter placed instead of the gas generating material 34. The flow rate was determined by introducing water drops into a linear microchannel 22 having a rectangular cross section of 50 μm depth and 200 μm width, pumping the water drops with the micropump 10 and analyzing video images of the pumping.

As also seen from FIG. 5, the flow rate of the micropump 10 could be controlled in multiple stages containing intermediate stages with high accuracy according to the pump output command value.

The control pulse signal CS is preferably fixed-length pulse train patterns PP repeated in a predetermined cycle as described previously. Thus, the generation of a control pulse signal CS can be much more facilitated than when the control pulse signal CS is repeated pulse train patterns arbitrarily variable in length and cycle. As a result, the configuration of the controller 50 can be simplified. This effect becomes more prominent as the number of micropumps 10 increases.

For example, when the number of micropumps 10 increases, if the arbitrary selection of the length and cycle of the pulse train pattern PP is permitted, the generation of a control pulse signal CS for each micropump becomes troublesome and the controller 50 becomes complicated. In contrast, if such a control pulse signal CS as described previously is used, these inconveniences can be prevented. Therefore, such a control pulse signal CS is advantageous in building a micropump device in which micropumps are integrated on a large scale.

Furthermore, the gas generating material 34 is preferably a material in which a decomposition reaction initiated by exposure to light due to turning on of the light source 42 terminates within a period of time shorter than the pulse duration $\tau$ of each bit in the control pulse signal CS after the next turning off of the light source 42. Examples of such a gas generating material 34 will be described hereinafter. The use of such a so-called highly responsive gas generating material 34 makes it possible to stop decomposition reaction of the gas generating material 34 promptly upon turning off of the light source 42. This suppresses undesirable accumulation of decomposition reaction and thereby facilitates accurate realization of a desired amount of gas generated. Finally, accurate realization of a desired amount of liquid fed by the micropump 10 can be facilitated.

Figure 6:
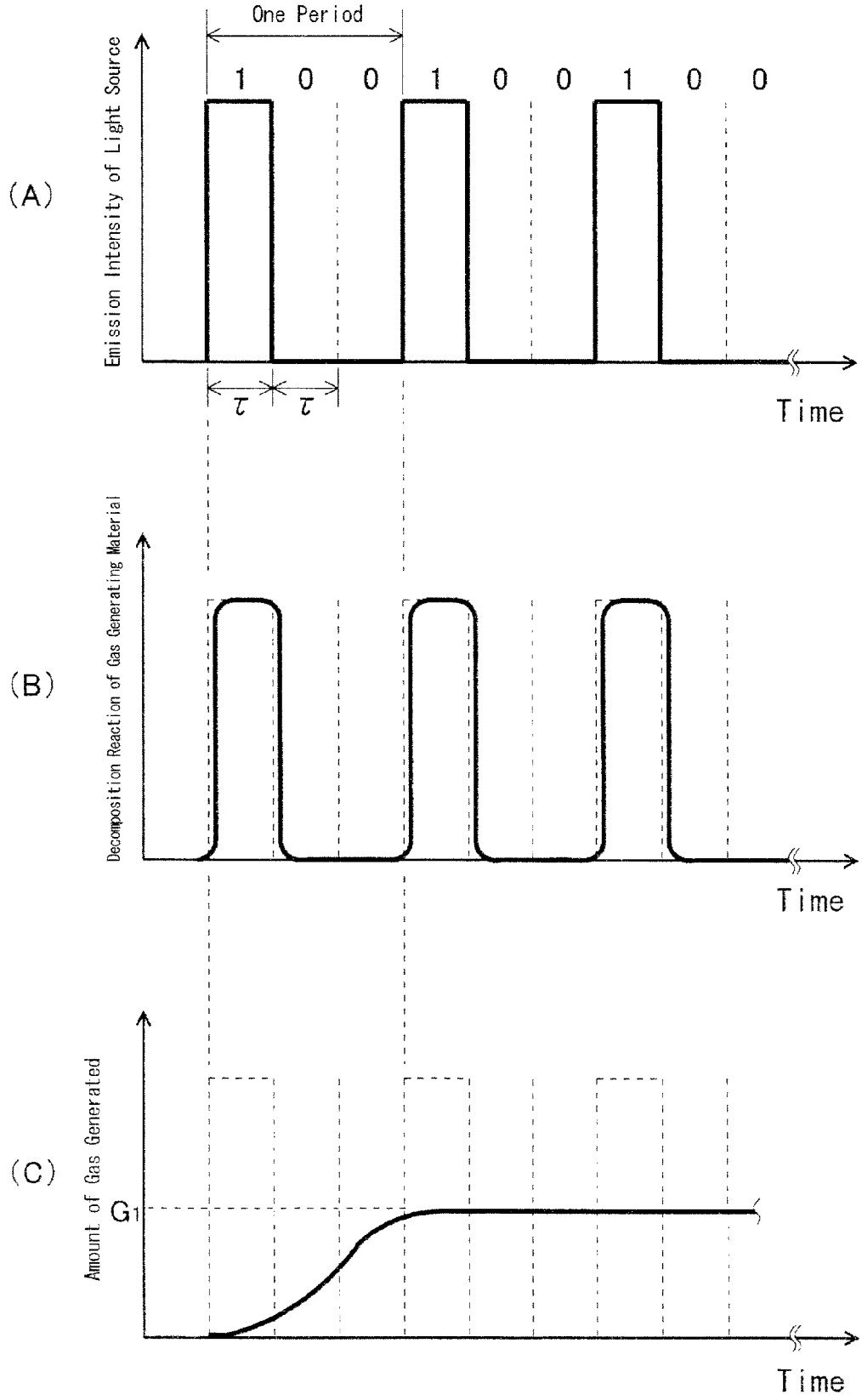
FIG. 6 is schematic diagrams showing an example of decomposition reaction response of a gas generating material.
Figure 7:
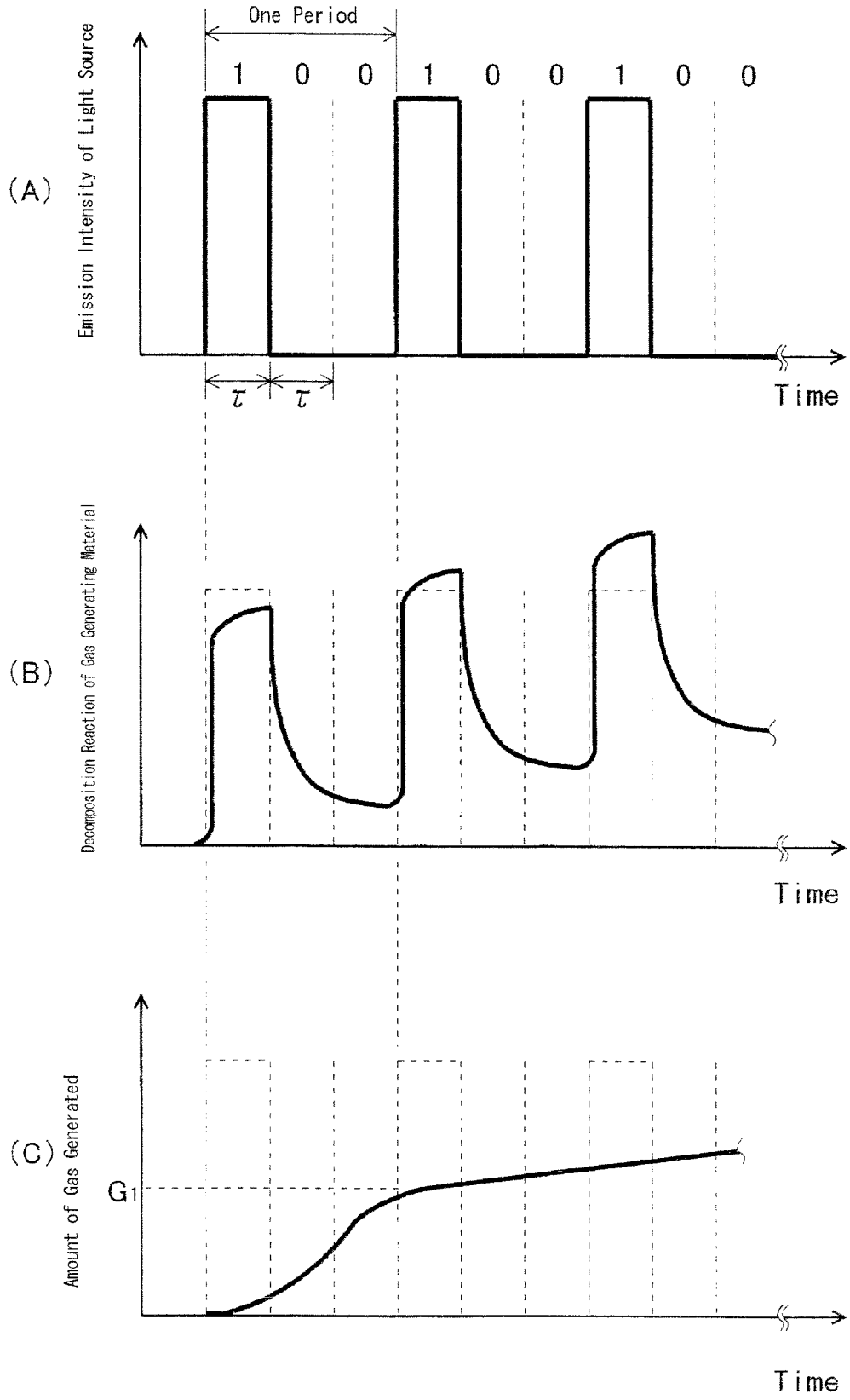
FIG. 7 is schematic diagrams showing another example of decomposition reaction response of a gas generating material.

An example of a response of a gas generating material 34 capable of stopping decomposition reaction promptly upon turning off of the light source 42 is shown in FIG. 6, while an example of a worse response is shown in FIG. 7. These figures are schematic diagrams, in which for simplicity each period of the blinking pattern of the light source 42 is composed of 3 bits (see FIG. 6A and FIG. 7A).

As shown in FIG. 6B, when a decomposition reaction of the gas generating material 34 terminates within a period of time shorter than the pulse duration $\tau$ after turning off of the light source 42, undesirable accumulation of decomposition reaction of the gas generating material 34 can be suppressed even if the blinking pattern of the light source 42 is repeated. This makes it easy to accurately realize a desired amount $G_1$ of gas generated (see FIG. 6C)

On the other hand, as shown in FIG. 7B, when a decomposition reaction of the gas generating material 34 does not terminate within a period of time shorter than the pulse duration $\tau$ after turning off of the light source 42, decomposition reaction of the gas generating material 34 is gradually accumulated during repetition of the blinking pattern of the light source 42 and the amount of gas generated gradually increases correspondingly. This makes it difficult to accurately realize the desired amount $G_1$ of gas generated (see FIG. 7C)

The pump output command value storage section 52 of the controller 50 may be configured so that the pump output command value stored therein can be rewritten during or before operation of the micropump 10. The rewriting may be implemented in a directly accessible manner, for example, using a DIP switch, or by software.

If the pump output command value storage section 52 is configured so that the pump output command value can be rewritten as described above, the change of the pump output command value can be immediately reflected on the output level of the micropump 10 to immediately change the output of the micropump 10.

(2) Examples of Gas Generating Material 34

As described previously, the gas generating material 34 is, for example, a material in which a compound generating a gas upon exposure to light is dispersed in or compatibly blended with a binder resin. The compound generating a gas upon exposure to light acts to generate a gas when irradiated with light. The binder resin acts to immobilize the compound generating a gas upon exposure to light or add various functions to the gas generating material.

Examples of the compound generating a gas upon exposure to light include a compound (A) generating a gas by photo-decomposition reaction, a mixture (B) of a photoacid generator and an acid-activated gas forming agent, and a mixture (C) of a photobase generator and a base proliferator.

Specific examples of the compound (A) generating a gas by photo-decomposition reaction include azo compounds, such as 2,2'-azobis-(N-butyl-2-methylpropionamide), azide compounds, such as 3-azidomethyl-3-methyloxetane, and polyoxyalkylene resins having an oxygen atom content of 15% to 55% by weight.

Specific examples of the mixture (B) of a photoacid generator and an acid-activated gas forming agent include a combination of: (a) a conventionally known photoacid generator efficiently decomposing upon exposure to light to generate a strong acid, such as at least one member selected from the group consisting of quinonediazide compounds, onium salts, sulfonate esters and organohologen compounds, more preferably, at least one member selected from the group consisting of sulfonic acid onium salts, benzylsulfonate esters, halogenated isocyanurates and bisarylsulfonyldiazomethane; and (b) an acid-activated gas forming agent generating a gas under stimulation of an acid or by action of an acid, such as sodium bicarbonate, sodium carbonate, sodium sesquicarbonate, magnesium carbonate, potassium carbonate, potassium bicarbonate, calcium carbonate or sodium borohydride.

Specific examples of the mixture (C) of a photobase generator and a base proliferator include a combination of: (a) a photobase generator decomposing upon exposure to light to generate a gaseous base, such as cobalt amine complexes, o-nitrobenzene carbamate, oxium esters or carbamoyloxyimino group-containing compounds; and (b) a base proliferator generating a basic gas by reaction with a basic gas, such as 9-fluorenylcarbamate derivatives.

The binder resin is incorporated into the gas generating material 34 in order to immobilize the compound generating a gas upon exposure to light or add various functions to the gas generating material 34.

Acrylic resins or epoxy resins are suitably used as a binder resin for immobilizing the compound generating a gas upon exposure to light. However, the binder resin is not limited to these resins, so long as it meets the objective of allowing the compound generating a gas upon exposure to light to be dispersed in or compatibly blended with the binder resin. The binder resin itself may have the capability of generating a gas under optical stimulation. For example, polyoxyalkylene resins having an oxygen atom content of 15% to 55% by weight generate a gas, upon exposure to light, while decomposing itself.

The gas generating material 34 may be attached to a support member. The support member is formed of, for example, a piece of nonwoven fabric. Using the gas generating material attached to the surface of the piece of nonwoven fabric, the surface area per unit volume of the gas generating material 34 can be increased to thereby increase the efficiency of gas generation, as compared to the case where only the gas generating material 34 is loaded into the gas generating chamber 32. More specifically, in the piece of nonwoven fabric that is a fibrous material, a large number of fibers are collected and intertwined with each other, whereby a generated gas is smoothly emitted to the outside through clearances between fibers. The gas generating material is made to adhere to the piece of nonwoven fabric by impregnating the piece of nonwoven fabric with the gas generating material so that the gas generating material adheres to the surface of each fiber in the piece of nonwoven fabric. In this case, the gas generating material is made to adhere to the piece of nonwoven fabric to an extent that clearances between fibers are left even after the gas generating material has adhered to the piece of nonwoven fabric forming the support member. Therefore, when a gas generates upon exposure to light, the gas is smoothly emitted to the outside through the clearances.

Although, for example, a piece of nonwoven fabric is used as a support member, other fibrous materials may be used. More specifically, the fibrous material used as a support member can be any suitable fibrous material in which cotton fibers, glass fibers, synthetic fibers, such as polyethylene terephthalate or acryl, pulp fibers or metal fibers are collected and intertwined with each other.

Furthermore, the material for the support member is not limited to fibrous materials, and various porous materials including fibrous materials can be used as a support member so long as a generated gas can be smoothly emitted to the outside. The term "porous material" used herein means a material having a large number of pores continuing to the external surface, and such porous materials include materials in which clearances between fibers continue to the outside, like the above-described nonwoven fabric.

Therefore, in addition to the above fibrous materials, porous materials in which a large number of pores continuing from inside to external surface are formed, such as sponges, foams subjected to defoaming treatment, porous gels, aggregates of fusion-bonded particles, gas pressure-assisted thickness-increased compacts, honeycomb structures, assemblies of cylindrical beads or assemblies of undulated chips, can also be suitably used as a porous material forming the support member. Furthermore, a measure for increasing the surface area of the gas generating material, such as the use of pillars, is preferably applied.

The material for the support member is not particularly limited, and various inorganic and organic materials can be used as the support member. Examples of such usable inorganic materials include glasses, ceramics, metals and metal oxides. Examples of such usable organic materials include polyolefins, polyurethanes, polyesters, nylons, celluloses, acetal resins, acryls, polyethylene terephthalates, polyamides and polyimides By containing the binder resin into the gas generating material 34, the gas generating material 34 can be easily processed into a desired form. For example, a gas generating material 34 in a solid form, such as a film-like form, can be easily obtained. Therefore, the binder resin is suitable also for the use of a thin gas generating material 34, like a film or tape as in a micropump 10 described hereinafter with reference to FIG. 15.

To give the gas generating material adhesiveness, the binder resin may contain, for example, an adhesive or pressure sensitive adhesive resin. By containing such an adhesive or pressure sensitive adhesive resin as a binder into the gas generating material 34, the adhesiveness or pressure sensitive adhesiveness between the gas generating material 34 and a substrate (for example, a substrate 21 in FIG. 15, the same applies to the description hereinafter) can be increased.

The adhesive or pressure sensitive adhesive resin is preferably a resin that does not deteriorate the adhesiveness owing to exposure to light. The reason for this is that such a property ensures that high adhesiveness or pressure sensitive adhesiveness between the gas generating material 34 and the substrate can be maintained even after the application of light to the gas generating material 34 is initiated. Furthermore, the adhesive or pressure sensitive adhesive resin is preferably a resin that cannot be crosslinked by exposure to light.

Specific examples of the adhesive or pressure sensitive adhesive resin include rubber adhesive or pressure sensitive adhesive resins, (meth)acrylic adhesive or pressure sensitive adhesive resins, silicone adhesive or pressure sensitive adhesive resins, urethane adhesive or pressure sensitive adhesive resins, styrene-isoprene-styrene copolymer adhesive or pressure sensitive adhesive resins, styrene-butadiene-styrene copolymer adhesive or pressure sensitive adhesive resins, epoxy adhesive or pressure sensitive adhesive resins, and isocyanate adhesive or pressure sensitive adhesive resins.

In addition to the compound generating a gas upon exposure to light and the binder resin, a photosensitizer may be incorporated into the gas generating material 34. Specific examples of the photosensitizer include well-known photosensitizers, such as thioxanthones, benzophenones, acetophenones and porphyrins.

The gas generating material 34 may further contain, in addition to the compound generating a gas upon exposure to light and the binder resin, various conventionally known additives, as necessary. Such additives include a coupling agent, a plasticizer, a surfactant and a stabilizer. The gas generating material 34 may be formed into a composite with porous body particles, filler particles, metal foil pieces, microcapsules or other kind of particles. Porous body particles, filler particles, metal foil pieces, microcapsules or other kind of particles dispersed in the gas generating material 34 are useful for apparently promoting the diffusion of the gas.

All of the gas generating materials 34 mentioned above can stop gas generation reaction promptly upon turning off of the light source 42. Therefore, these materials are suitable as a highly responsive gas generating material 34 described previously.

The gas generating material 34 may be further blended with a chain reaction inhibitor, as necessary.

Examples of the chain reaction inhibitor include well-known radical scavengers, such as t-butyl catechol, hydroquinone, methyl ether, enzymes including catalases, glutathione peroxidases and superoxide dismutases, vitamin C, vitamin E, polyphenols or linolenic acids. However, the chain reaction inhibitor is not limited to these radical scavengers, and any substance can be used so long as it has the effect of inhibiting chain reaction.

The chain reaction inhibitor is an agent for partly inhibiting the chain-propagation step of chain reaction but not an agent for inhibiting the chain-initiation step thereof.

(3) Common Description of Other Embodiments of Micropump Device

In explaining each of embodiments shown in FIGS. 8 to 12, the same parts as or the corresponding parts to those of the previously described embodiment (for example, the embodiment shown in FIG. 2) are identified by the same reference numerals, and different points from the previously described embodiment will be mainly described.

Each of micropump devices shown in FIGS. 8 to 12 includes a plurality of such micropumps 10 as described previously herein. Note that in these figures the micropumps 10 and other elements are simplified. The details of each micropump 10 and other elements are referred not to these figures but to the description of the former embodiment, for example, the description of the embodiment shown in FIG. 2.

Microchannels 22 each forming part of one of the plurality of micropumps 10 may be provided in a single channel substrate 20 or provided in separate members. Gas generating chambers 32 may also be provided in a single pump substrate 30 or provided in separate members. Light sources 42 may also be provided in a single light source substrate 40 or separately.

In examples shown in FIGS. 8 to 12, the number of micropumps 10 is relatively small for the sake of simplicity. However, the number of micropumps 10 is not limited to those shown in these examples. The microchannels 22 (see FIG. 2) of the plurality of micropumps 10 may be independent of each other or all or part of them may communicate with each other. The plurality of micropumps 10 may be arranged in one dimension or two dimensions.

Each of controllers 50 shown in FIGS. 8 to 12 is configured to supply a plurality of control pulse signals $CS_1$ to $CS_4$ (or $CS_1$ to $CS_8$, for example) to the respective individual light sources 42 of the plurality of micropumps 10. Each control pulse signal $CS_1$ to $CS_4$ (or $CS_1$ to $CS_8$, for example) is a signal similar to the control pulse signal CS described previously. Therefore, the plurality of micropumps 10 can be individually controlled by a single controller 50. This makes it easy to build a micropump device including a large number of micropumps.

(4) Second Embodiment

Figure 8:
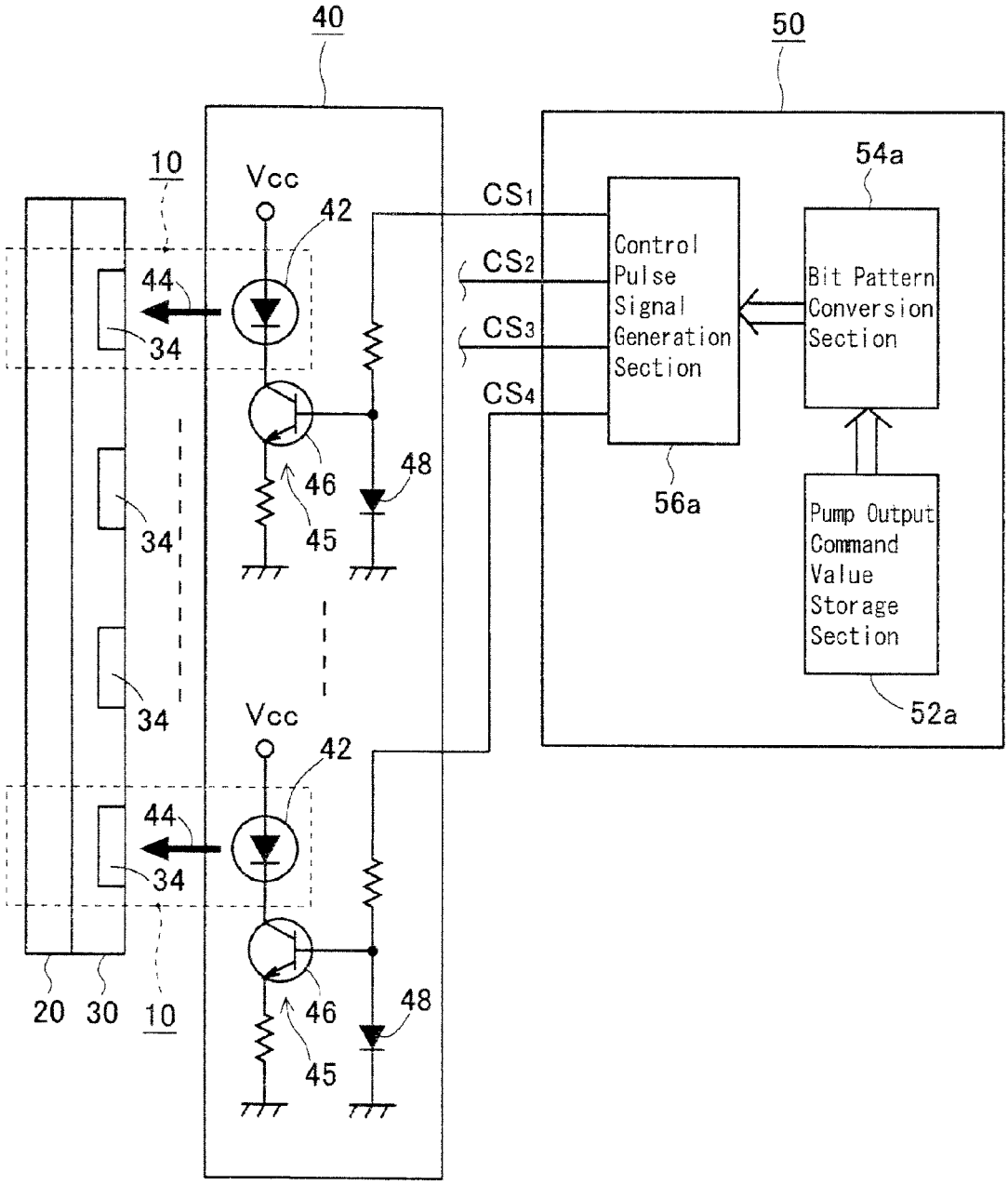
FIG. 8 is a diagram showing another embodiment of the micropump according to the present invention.

In the embodiment shown in FIG. 8, the controller 50 includes: a pump output command value storage section **52*a* for storing a plurality of pump output command values for respective individual instructions on respective output levels of the micropumps 10; a bit pattern conversion section 54*a* for converting the plurality of the pump output command values in the pump output command value storage section 52*a* to the same plurality of respective individual bit patterns corresponding to respective pulse train patterns PP of respective control pulse signals $CS_1$ to $CS_4$ for the micropumps 10 and outputting the bit patterns; and a control pulse signal generation section 56*a* for generating the respective control pulse signals $CS_1$ to $CS_4$ for the micropumps 10 based on the bit patterns output from the bit pattern conversion section 54*a* and outputting the control pulse signals $CS_1$ to $CS_4$ in parallel. The control pulse signals $CS_1$ to $CS_4$ are supplied to the individual light sources 42**.

The control pulse signal generation section **56*a* includes a storage means (for example, a memory, a register or the like) for storing the plurality of bit patterns having been supplied from the bit pattern conversion section 54*a***.

To stop a desired one of the micropumps 10, the pump output command value for the target micropump 10 is changed to zero. The same applies to the embodiments described hereinafter.

The pump output command value storage section **52*a* may be configured so that the plurality of pump output command values stored therein can be rewritten during or before operation of the micropumps 10. If the pump output command value storage section 52*a* is configured so that the pump output command values can be rewritten as described above, the change of each pump output command value can be immediately reflected on the output level of the relevant micropump 10 to immediately change the output of the relevant micropump 10. The same applies to the pump output command value storage sections 52*a* shown in FIGS. 9 to 12**.

(5) Third Embodiment

Figure 9:
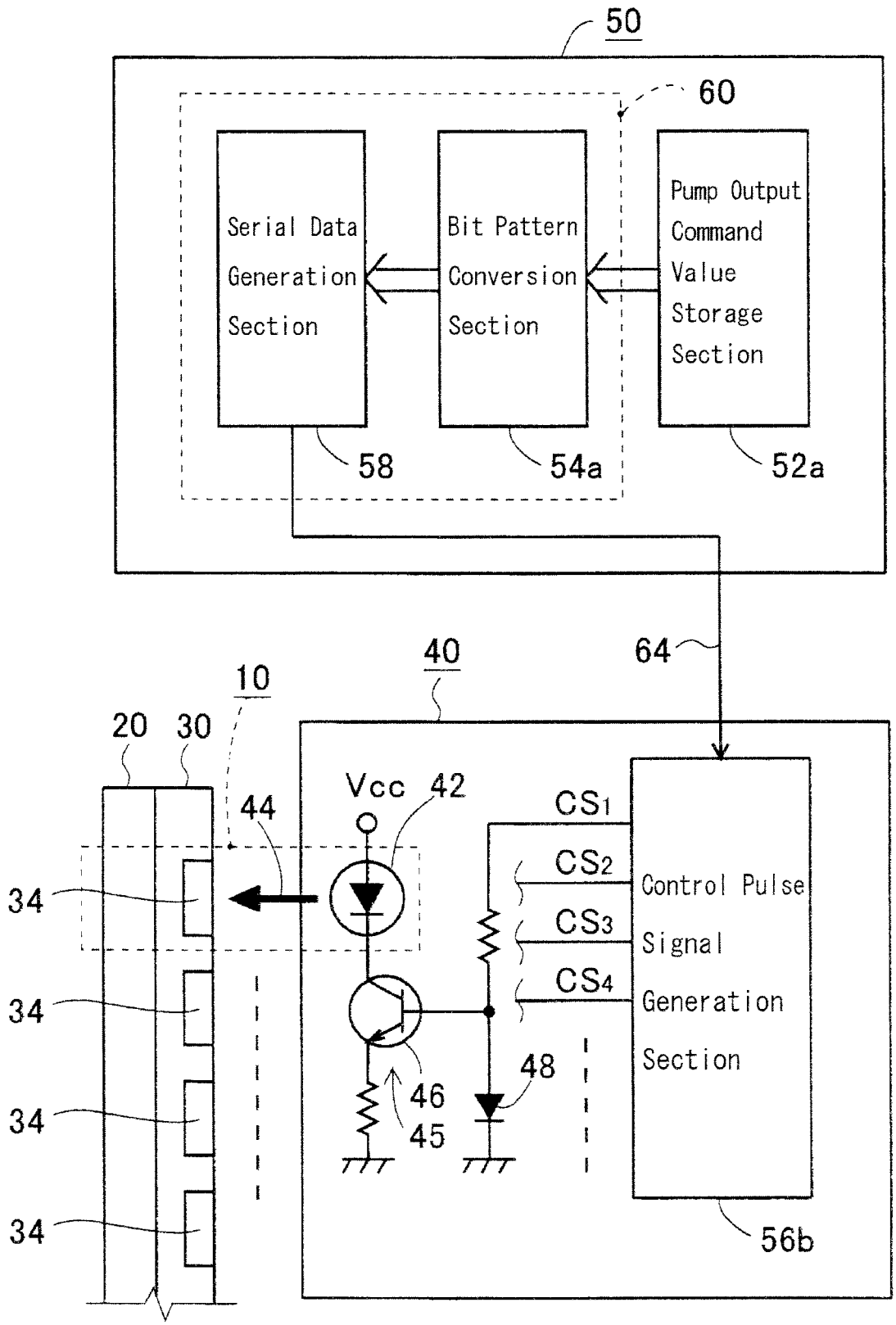
FIG. 9 is a diagram showing still another embodiment of the micropump according to the present invention.

In the embodiment shown in FIG. 9, the controller 50 includes a pump output command value storage section **52*a*** and a bit pattern conversion section 54*a* as both described in FIG. 8, a serial data generation section 58 for serially outputting sets of bit data, each set of bit data constituting one of the respective bit patterns for the micropumps 10 output from the bit pattern conversion section 54*a*, and a control pulse signal generation section 56*b* for generating respective control pulse signals $CS_1$ to $CS_4$ . . . for the micropumps 10 in parallel based on the sets of bit data output from the serial data generation section 58 and outputting the control pulse signals $CS_1$ to $CS_4$ . . . in parallel. The control pulse signals $CS_1$ to $CS_4$ . . . are supplied to the individual light sources 42.

The signal from the serial data generation section 58 to the control pulse signal generation section 56*b* is transmitted via a transmission channel 64. The transmission channel 64 may be made of, for example, a cable, a wireless channel or infrared rays or may be a channel via Internet.

In this embodiment, the control pulse signal generation section 56*b* is mounted on the light source substrate 40. The reason for this is that the signal lines for control pulse signals $CS_1$ to $CS_4$ . . . can be shortened as much as possible. The control pulse signal generation section 56*b* is located away from the serial data generation section 58 and the other controller components, but in terms of function forms part of the controller 50. The same applies to a control pulse signal generation section 56*c* shown in FIG. 10.

The serial data generation section 58 includes, for example, a bit pattern storage section (for example, a memory, a register or the like) for storing a plurality of bit patterns supplied from the bit pattern conversion section 54*a*, and a parallel-to-serial data converter for outputting sets of bit data, which have been retrieved in parallel from the bit pattern storage section, serially bit by bit. The parallel-to-serial data converter is, for example, a shift register.

The control pulse signal generation section 56*b* includes a serial-to-parallel data converter for sorting sets of bit data, which have been serially supplied from the serial data generation section 58, into respective bit patterns for the micropumps 10 and outputting the bit patterns in parallel. The serial-to-parallel data converter is, for example, a shift register.

To simplify the description hereinafter, the circuit including the bit patter conversion section 54*a* and the serial data generation section 58 will be referred to as a conversion circuit 60.

According to this embodiment, sets of bit data each constituting one of the respective bit patterns for the plurality of micropumps 10 can be serially transmitted from the serial data generation section 58 to the control pulse signal generation section 56*b*. Therefore, the number of transmission channels 64 can be reduced. In addition, no matter how much the number of micropumps 10 increases, the necessary number of transmission channels 64 is constant.

For example, only one transmission channel 64 for transmitting sets of bit data is necessary. Even if, in addition to the bit data, auxiliary signals (for example, signals corresponding to a clock signal CLK and a latch signal LCH both shown in FIG. 10) must be transmitted, the necessary number of transmission channels 64 is no more than three. In addition, no matter how much the number of micropumps 10 is increased, the necessary number of transmission channels 64 is kept at the above number.

As a result, it becomes easy to place the control pulse signal generation section 56*b* near to the light sources 42 for the plurality of micropumps 10 and place the remaining components of the controller 50 (i.e., the pump output command value storage section 52*a* and the conversion circuit 60) separately from the light sources 42. Therefore, the wire routing can be simplified and the flexibility of device configuration can be significantly increased. These effects become more prominent as the number of micropumps increases.

For example, like this embodiment, the control pulse signal generation section 56*b* can be mounted on the light source substrate 40 in common with the light sources 42, while the remaining components of the controller 50 can be arranged in arbitrary positions away from the light source substrate 40.

In addition, the above configuration can easily respond to increases in the number of micropumps. For example, if in the embodiment shown in FIG. 8 the number of micropumps 10 increases to about 40 to 200 or more, the number of signal lines for control pulse signals $CS_1$, . . . between the controller 50 and the light source substrate 40 also increases to the same number. This makes it troublesome to route the signal lines. In contrast, since in this embodiment the control pulse signal generation section 56*b* can be placed near to the light sources 42 and, for example, the control pulse signal generation section 56*b* can be mounted on the light source substrate 40 in common with the light sources 42, the signal lines for the control pulse signals $CS_1$, . . . can be very short. Therefore, the routing of the signal lines can be easily made. In addition, no matter how much the number of micropumps 10 increases, the necessary number of transmission channels 64 is constant as described previously. Therefore, the above configuration can easily respond to increases in the number of micropumps, which makes it easy to build a micropump device integrated on a large scale.

(6) Fourth Embodiment

Figure 10:
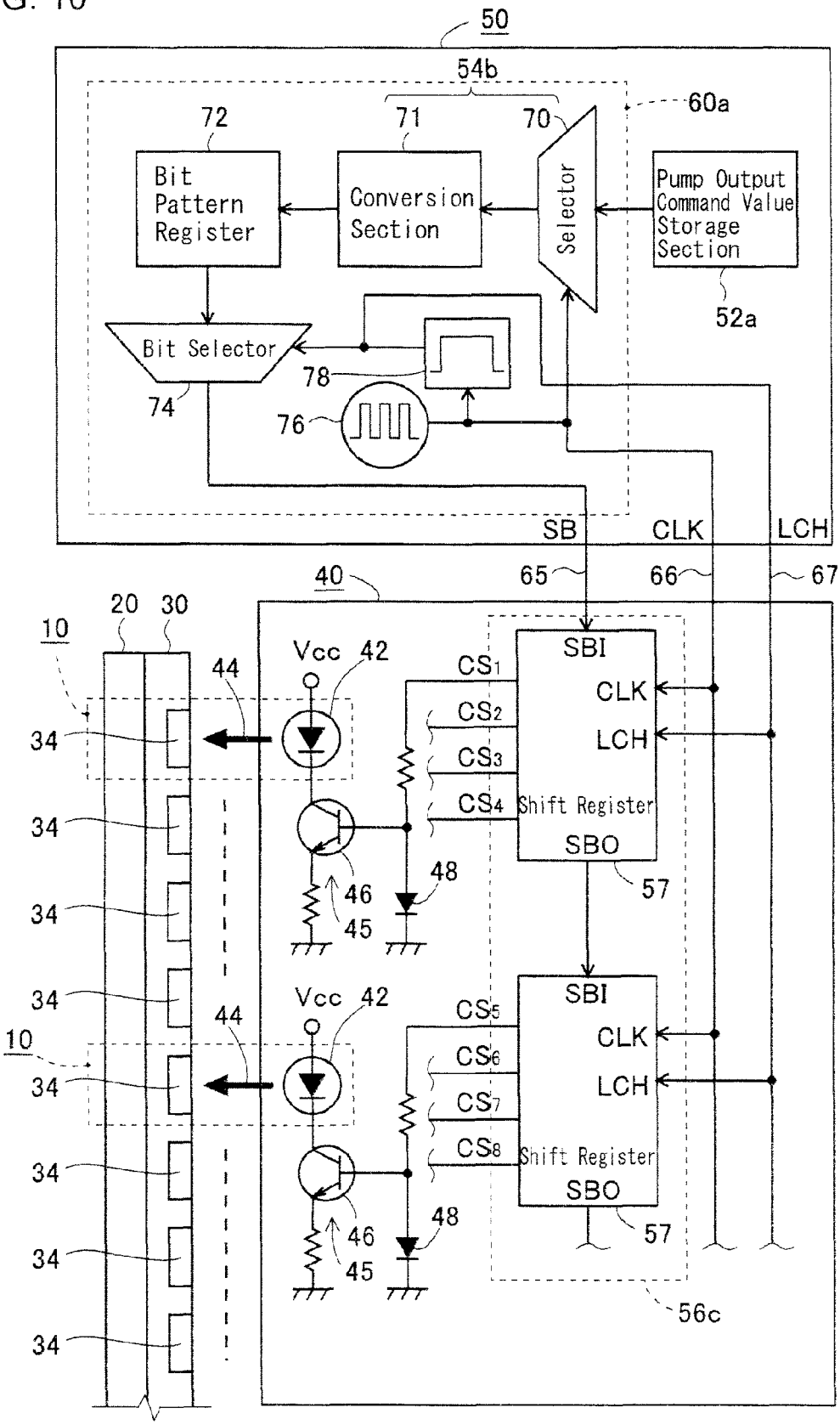
FIG. 10 is a diagram showing still another embodiment of the micropump according to the present invention.

In the embodiment shown in FIG. 10, the controller 50 includes: a pump output command value storage section 52*a* for storing a plurality of pump output command values for respective individual instructions on respective output levels of the micropumps 10; a clock signal generation section 76 for generating a clock signal CLK for synchronization with serial transmission of bit data; and a latch signal generation section 78 for generating a latch signal LCH each time the periods of the clock signal CLK are counted to the number of micropumps 10.

The pump output command value storage section 52*a* is, for example, like the pump output command value storage sections 52*a* shown in FIGS. 8 and 9. Note that in this embodiment pump output command values are retrieved one by one from the pump output command value storage section 52*a* by a bit pattern conversion section 54*b* described below.

The clock signal generation section 76 outputs one pulse of the clock signal CLK in a predetermined cycle, for example, in a cycle of 0.25 ms.

The latch signal generation section 78 outputs one pulse each time the periods of the clock signal CLK are counted to the number of micropumps 10. This is a latch signal LCH. For example, if the period of the clock signal CLK is 0.25 ms and the number of micropumps 10 is 40, one pulse is output every 0.25×40=10 ms. In other words, the period of the latch signal LCH is 10 ms in this example.

The controller 50 further includes: a bit pattern conversion section 54*b* for sequentially retrieving the pump output command values in the pump output command value storage section 52*a* one by one in timed relation to the clock signal CLK, sequentially converting the pump output command values to individual bit patterns corresponding to the respective pulse train patterns PP of respective control pulse signals CS for the micropumps 10 and sequentially outputting the bit patterns; a bit pattern register 72 for storing the bit pattern for one pump output command value just output from the bit pattern conversion section 54*b*; and a bit selector 74 for retrieving one bit of bit data from the bit pattern in the bit pattern register 72 in timed relation to each period of the clock signal CLK and shifting the position of the bit pattern at which one bit of bit data is to be retrieved from digit to digit according to the latch signal LCH, thereby outputting sets of bit data as respective serial bit patterns SB, each set of bit data being composed of bits of the same digit in the plurality of bit patterns for the plurality of micropumps 10.

In this embodiment, the bit pattern conversion section 54*b* includes a cyclic selector 70 for sequentially retrieving and outputting the pump output command values in the pump output command value storage section 52*a* while circulating the pump output command values one by one in timed relation to the clock signal CLK, and a conversion section 71 for, each time one pump output command value is output from the cyclic selector 70, converting the pump output command value to a bit pattern and outputting the bit pattern. The conversion section 71 has substantially the same function, for example, as the bit pattern conversion section 54 shown in FIG. 2.

The bit pattern register 72 stores one latest bit pattern each time one bit pattern is output from the conversion section 71.

The operation of the bit selector 74 will now be described with reference to FIG. 14. In FIG. 14, for ease of understanding, a plurality of bit patterns are conveniently arranged to align their digit positions. However, actually, the plurality of bit patterns are not arranged in such a matrix as shown in FIG. 14. Furthermore, FIG. 14 shows, for ease of explanation, an example in which the number of pumps is four and each bit pattern is composed of 8 bits. However, the configurations of the pump and bit pattern are not limited to the above.

In the bit pattern register 72, bit patterns are sequentially overwritten one by one in timed relation to each period of the clock signal CLK (for example, once in every 0.25 ms), for example, first a bit pattern for Pump Number 1, next a bit pattern for Pump Number 2, and so on.

What is stored in the bit pattern register 72 is always a single bit pattern.

The bit selector 74 retrieves one bit of bit data from the bit pattern in the bit pattern register 72 in timed relation to each period of the clock signal CLK. In this case, since the bit pattern in the bit pattern register 72 is overwritten in timed relation to each period of the clock signal CLK as described above, finally, the bit selector 74 sequentially retrieves and outputs, for example, a set of bit data of the first digit shown in FIG. 14, bit by bit in timed relation to each period of the clock signal CLK. This means that sets of bit data, each set composed of bits of the same digit in the plurality of bit patterns, are output as respective serial bit patterns SB as described above. Furthermore, the bit selector 74 shifts the digit position of the bit pattern at which bit data is to be retrieved from digit to digit in timed relation to each particular change of the latch signal LCH (for example, each rising edge thereof, the same applies to the embodiments described hereinafter). For example, the digit position of the bit pattern at which bit data is to be retrieved is shifted first to the second digit, then to the third digit and so on.

By the above operation, a serial bit pattern SB, for example, in which bits of the first digit for Pump Numbers 1 to are serially arranged (in other words, arranged in time sequence), is output from the bit selector 74, a serial bit pattern SB of bits of the second digit for Pump Numbers 1 to 4 is next output, and serial bit patterns SB are sequentially output in the same manner up to a serial bit pattern SB of bits of the eighth digit. Thereafter, the same operation is repeated.

The controller 50 further includes: three transmission channels 65 to 67, one for transmitting serial bit patterns SB output from the bit selector 74, another for transmitting the clock signal CLK output from the clock signal generation section 76 and the other for transmitting the latch signal LCH output from the latch signal generation section 78; and a control pulse signal generation section 56*c* that includes shift registers 57 for taking the serial bit patterns SB, the clock signal CLK and the latch signal LCH sent via the transmission channels 65 to 67, generates respective control pulse signals $CS_1$ to $CS_8$ for the micropumps 10 in parallel based on the serial bit patterns SB, and outputs the control pulse signals $CS_1$ to $CS_8$ in parallel. The control pulse signals $CS_1$ to $CS_8$ are supplied to the individual light sources 42.

The transmission channels 65 to 67 may be made of, for example, a cable, a wireless channel or infrared rays or may be channels via Internet.

In the example shown in FIG. 10, the control pulse signal generation section 56*c* includes two shift registers 57 connected in series with each other. However, the number of shift registers 57 is not limited to two and may be selected based on the relation between the number of bits (the number of output terminals) and the number of micropumps 10. In other words, if the number of bits in one shift register 57 is small relative to the number of micropumps 10, a number of shift registers 57 large enough to eliminate the shortage may be connected in series with each other. In FIG. 10, reference character SBI denotes an input terminal for serial bit patterns SB and reference character SBO denotes an output terminal for overflow serial bit patterns SB.

Each shift register 57 is a well-known shift register, and performs a substantially reverse operation to the operation of the bit selector 74 to sort the set of bit data of each serial bit pattern SB taken therein into respective individual bits of bit data for the micropumps 10 in timed relation to each period of the clock signal CLK and output the sorted patterns of bit data in parallel in timed relation to each period of the latch signal LCH. The shift register 57 holds the previous states for a cycle of the latch signal LCH (for example, for 10 ms as described previously). By this operation, the control pulse signals $CS_1$ to $CS_8$ can be output in parallel from the two shift registers 57, i.e., the control pulse signal generation section 56*c*.

To simplify the description hereinafter, the circuit including the bit pattern conversion section 54*b*, the bit pattern register 72, the bit selector 74, the clock signal generation section 76 and the latch signal generation section 78 will be referred to as a conversion circuit 60*a*.

In this embodiment, any type of bit pattern register 72 will do if it can store a bit pattern for one pump output command value. Therefore, even if the number of micropumps 10 increases, there is no need to increase the capacity of the bit pattern register 72. Thus, the total capacity of storage sections necessary for the controller 50 can be reduced to a small amount. This reduces the size and cost of the controller 50 and makes it easy to build a large-scale micropump device including a large number of micropumps.

In addition, since the controller 50 has a system of serially transmitting bit data constituting the bit patterns for the micropumps 10, it can perform the same effects as those of the embodiment shown in FIG. 9.

More specifically, regardless of the number of micropumps 10, the number of transmission channels 65 to 67 can be three. Furthermore, it is easy to place the control pulse signal generation section 56*c* near to the light sources 42 for the plurality of micropumps 10, for example, mount it on the light source substrate 40, and place the remaining components of the controller 50 separately from the light sources 42. Therefore, the wire routing can be simplified and the flexibility of device configuration can be increased. Therefore, the above configuration can easily respond to increases in the number of micropumps, which makes it easy to build a micropump device integrated on a large scale.

(7) Fifth Embodiment

Figure 11:
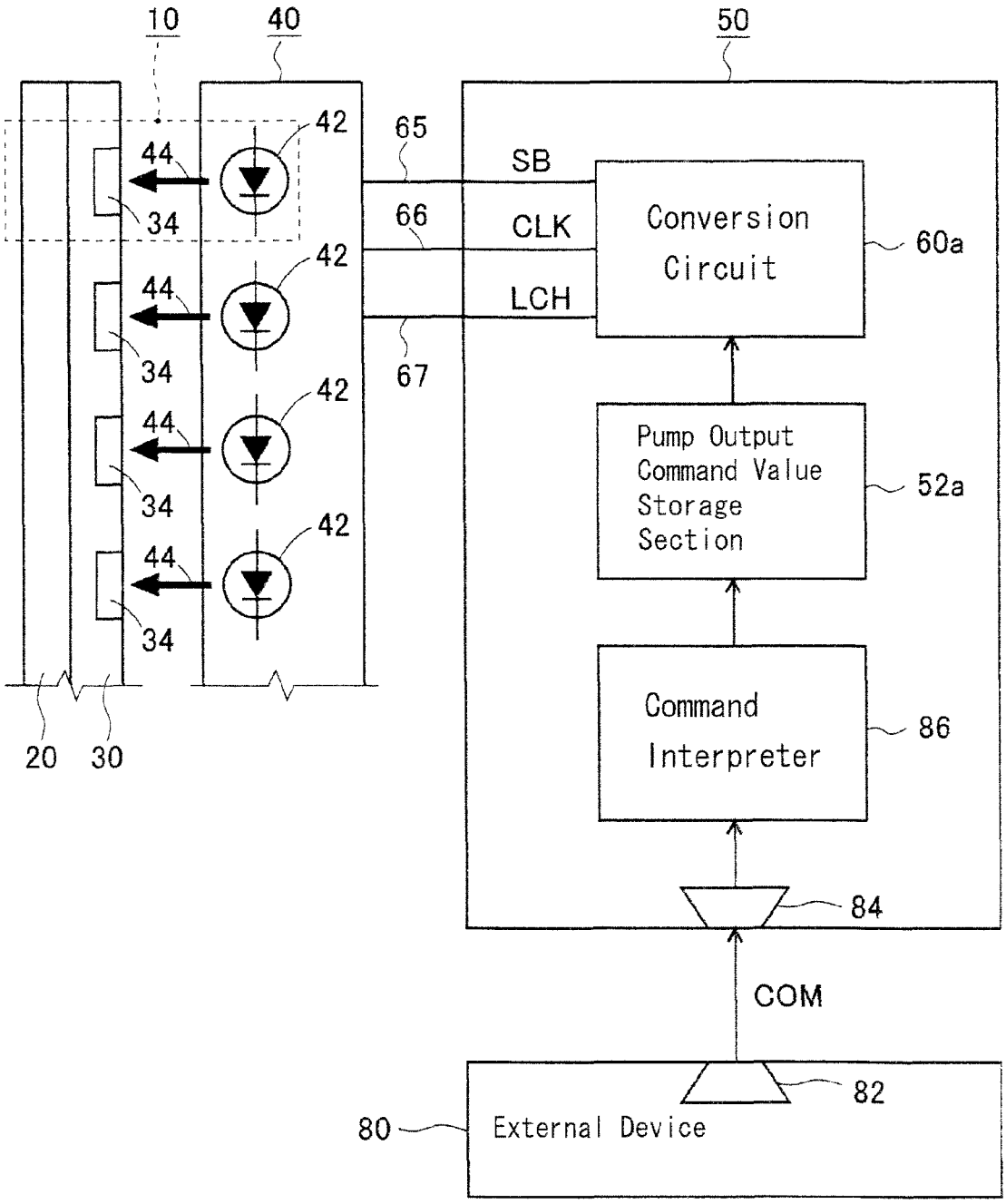
FIG. 11 is a diagram showing still another embodiment of the micropump according to the present invention.

In an embodiment shown in FIG. 11, the controller 50 includes, in addition to the pump output command value storage section 52*a* and conversion circuit 60*a* shown in FIG. 10, a command interpreter 86 for interpreting a command sequence COM given from the outside and rewriting a plurality of pump output command values in the pump output command value storage section 52*a* during or before operation of the micropumps 10. In contrast to a command interpreter 86*a* shown in FIG. 12, the command interpreter 86 immediately executes, in response to the command sequence COM, the operation of rewriting one or more pump output command values in the pump output command value storage section 52*a*.

The structure of the light source substrate 40 is the same as in the embodiment shown in FIG. 10 and, therefore, is simplified in FIG. 11. The same applies to the embodiment shown in FIG. 12.

The command sequence COM includes, for example, commands for instructions on respective pump numbers and pump output command values for a plurality of micropumps 10 and commands for starting up or stopping the micropumps 10.

The command sequence COM is, for example, an interactive command sequence of ASCII (abbreviation of American Standard Code for Information Interchange) characters.

The command sequence COM is given to the command interpreter 86, for example, from an external device 80 through communication parts 82 and 84. The external device 80 is, for example, a personal computer. Examples of an applicable means for transmitting the command sequence COM include well-known means, such as a cable, a wireless channel, an infrared wireless channel, and Internet.

Since in this embodiment the controller 50 includes the command interpreter 86 as described above, the operations and outputs of the individual micropumps 10 can be dynamically controlled at arbitrary timings by a command sequence COM given from the outside. Therefore, the control over each micropump 10 is made more flexible and easier.

(8) Sixth Embodiment

Figure 12:
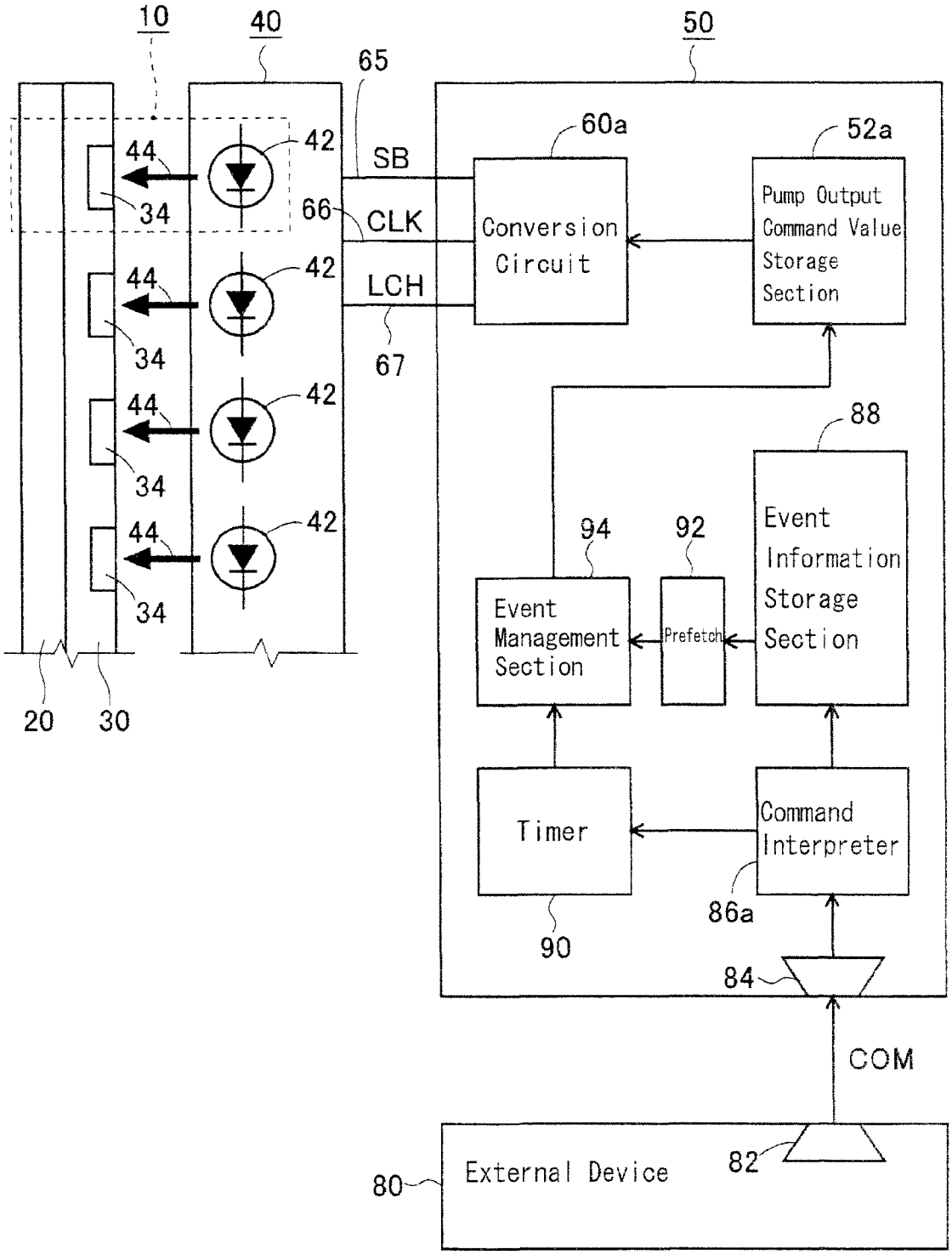
FIG. 12 is a diagram showing still another embodiment of the micropump according to the present invention.

In the embodiment shown in FIG. 12, the controller 50 includes, instead of the command interpreter 86 shown in FIG. 11, a command interpreter 86*a*, an event information storage section 88, a timer 90, a prefetch section 92, and an event management section 94.

The command interpreter 86*a* interprets a command sequence COM given from the outside, and generates a plurality of pieces of event information (also called event closures) each formed of a set of a pump number, a pump output command value and a scheduled execution time.

The structure of an example of one piece of event information is shown in FIG. 13A. The piece of event information is formed of a set of a scheduled execution time, a pump number and a pump output command value. An example of an event information sequence formed of a plurality of such pieces of event information is shown in FIG. 13B. In this example, all of the scheduled execution times, the pump numbers and the pump output command values are expressed in integers. However, the expression of these values is not limited to integers.

In this embodiment, the command sequence COM given to the command interpreter 86*a* contains a command for instruction on the scheduled execution time.

The event information storage section 88 stores the plurality of pieces of event information sent from the command interpreter 86*a*. More specifically, the event information storage section 88 stores such an event information sequence as shown as an example in FIG. 13B.

The timer 90 counts the reference time.

The prefetch section 92 retrieves the plurality of pieces of event information from the event information storage section 88 prior to execution of the pieces of event information. More specifically, the prefetch section 92 retrieves the pieces of event information from the event information sequence in order of scheduled execution time.

The event management section 94 compares the scheduled execution times in the pieces of event information retrieved into the prefetch section 92 with the time of the timer 90. If there is a piece of event information the scheduled execution time for which has come, the event management section 94 gives the pump output command value for the pump number in that piece of event information to the pump output command value storage section 52*a* to rewrite the pump output command value for the relevant pump number in the pump output command value storage section 52*a*. Thus, the output of the relevant micropump 10 is changed.

Since in this embodiment the controller 50 includes the command interpreter 86*a*, the event information storage section 88, the event management section 94 and so on as described above, the pieces of event information based on the command sequence COM given from the outside can be previously stored and the individual micropumps 10 can be controlled at their respective scheduled execution times. In other words, the individual micropumps 10 can be controlled outside the control of the external device 80, so to say, autonomously. In addition, since the controller 50 stores pieces of event information based on a command sequence COM given from the outside, there is no need to always give a command sequence to the controller 50, which removes any limitation on the command sequence COM in terms of communication speed. As a result, the controller 50 can respond to a micropump device integrated on a larger scale.

The event information storage section 88 may be configured using a non-volatile storage means. In this case, even if the controller 50 is powered off after a command sequence COM is given from the external device 80 to the controller 50, and then activated again, the controller 50 can autonomously control the outputs of the individual micropumps 10.

The technical idea of using such a command interpreter 86 and so on as shown in FIG. 11 and the technical idea of using such a command interpreter 86*a*, event management section 94 and so on as shown in FIG. 12 may be applied to the controllers 50 shown in FIGS. 1, 8 and 9.

(9) Other Examples of Micropump 10

The micropump 10 may include no gas generation chamber 32. It suffices if a gas generated from the gas generating material 34 upon exposure to light 44 from the light source 42 can be fed to the microchannel 22. Thus, an action as a pump as described previously can be implemented. More specifically, the micropump 10 can feed to the microchannel 22 the gas generated from the gas generating material 34, thereby transporting the liquid in the microchannel 22 by the volume of the gas fed and serving as a pump.

Figure 15:
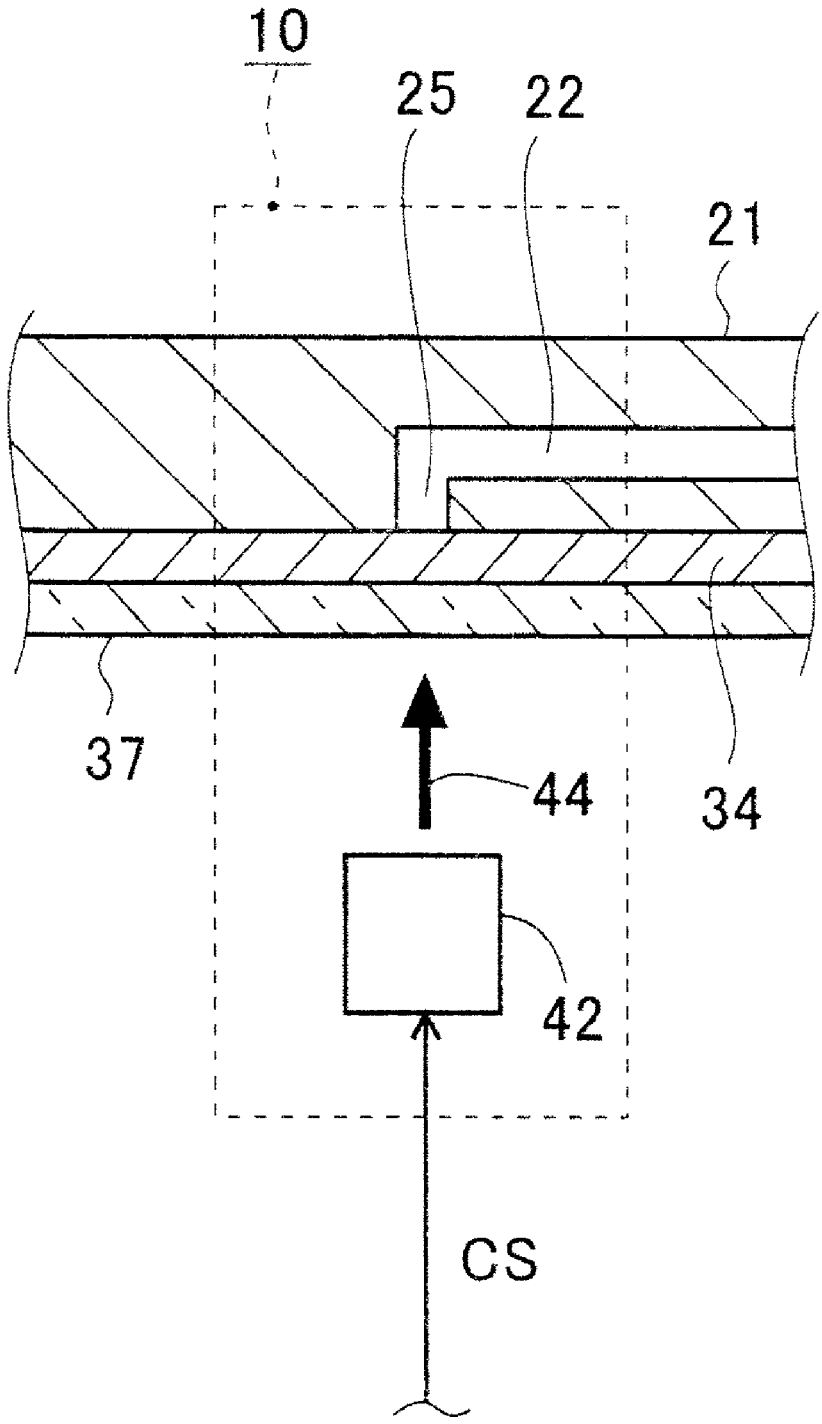
FIG. 15 is a diagram showing another example of a micropump.

An example of such a micropump 10 including no gas generating chamber 32 is shown in FIG. 15.

The micropump 10 includes: a microchannel 22 formed in the substrate 21 and having an opening 25 open to the principal surface of the substrate 21; a gas generating material 34 placed at the principal surface of the substrate 21 to cover the opening 25 of the microchannel 22; and a light source 42 for irradiating a region of the gas generating material 34 covering the opening 25 of the microchannel 22 with light 44.

The substrate 21 and the gas generating material 34 are bonded to each other, for example, through an unshown adhesive layer.

A control pulse signal CS is supplied to the light source 42 from, for example, the controller 50 shown in FIG. 1. The micropump device may include a plurality of such micropumps 10 as described above. In this case, a plurality of control pulse signals $CS_1$, $CS_2$, . . . are individually supplied to respective light sources 42 of the micropumps 10 from, for example, one of the controllers 50 shown in FIGS. 8 to 12.

The description of the microchannel 22, the gas generating material 34, the light source 42, the controller 50 and so on is referred to the description in the previous embodiments, and is therefore not given again here.

A light-transmissive gas barrier layer 37 capable of blocking gases may be disposed on the surface of the gas generating material 34. In this manner, a gas generated at the gas generating material 34 can be efficiently fed to the microchannel 22. This makes it easy to provide a high gas pressure to the microchannel 22.

The substrate 21, the gas generating material 34 and the gas barrier layer 37 may have the shape of, for example, a film, a tape or the like.

Such a micropump 10 as described above provides a micropump 10 further reduced in size and thickness. As a result, it becomes easy to build, for example, a micropump array in which a large number of micropumps 10 are integrated on a large scale.

The invention claimed is:

1. A micropump device comprising:

(a) a micropump including a microchannel serving as a channel for liquid, a gas generating material generating a gas upon exposure to light and supplying the gas to the microchannel, and a light source for irradiating the gas generating material with light; and (b) a controller for supplying a control pulse signal to the light source, the control pulse signal causing the light source to blink on and off in a binary manner by repeating a pulse train pattern composed of a fixed number of bits each capable of having two states one of which is a first level allowing the light source to be turned on and the other of which is a second level allowing the light source to be turned off, wherein the controller comprises:

a pump output command value storage section for storing a pump output command value for an instruction on an output level of the micropump;

a bit pattern conversion section for converting the pump output command value in the pump output command value storage section to a bit pattern corresponding to the pulse train pattern of the control puke signal and outputting the bit pattern; and a control pulse signal generation section for generating the control pulse signal based on the bit pattern output from the bit pattern conversion section, wherein the pump output command value storage section is configured so that the pump output command value stored therein can be rewritten during or before operation of the micropump, wherein the micropump device includes a plurality of the micropumps, and the controller is configured to supply a plurality of control pulse signals to respective individual light sources of the plurality of micropumps, wherein the controller further comprises:

a pump output command value storage section for storing a plurality of pump output command values for respective individual instructions on respective output levels of the micropumps;

a bit pattern conversion section for converting the plurality of pump output command values in the pump output command value storage section to the same plurality of respective individual bit patterns corresponding to respective pulse train patterns of respective control pulse signals for the micropumps and outputting the plurality of bit patterns; and a control pulse signal generation section for generating the respective control pulse signals for the micropumps based on the bit patterns output from the bit pattern conversion section and outputting the control pulse signals in parallel, wherein the controller further comprises:

a command interpreter for interpreting a command sequence given from the outside and generating a plurality of pieces of event information each formed of a set of a pump number, a pump output command value and a scheduled execution time;

an event information storage section for storing the plurality of pieces of event information;

a timer for counting the time;

a prefetch section for retrieving the plurality of pieces of event information from the event information storage section prior to execution of the pieces of event information; and an event management section for comparing the scheduled execution times in the pieces of event information retrieved into the prefetch section with the time of the timer and, if there is a piece of event information the scheduled execution time for which has come, giving the pump output command value for the pump number in that piece of event information to the pump output command value storage section to rewrite the pump output command value for the corresponding pump number in the pump output command value storage section.

2. A micropump device comprising:

(a) a micropump including a microchannel serving as a channel for liquid, a gas generating material generating a gas upon exposure to light and supplying the gas to the microchannel, and a light source for irradiating the gas generating material with light; and (b) a controller for supplying a control pulse signal to the light source, the control pulse signal causing the light source to blink on and off in a binary manner by repeating a pulse train pattern composed of a fixed number of bits each capable of having two states one of which is a first level allowing the light source to be turned on and the other of which is a second level allowing the light source to be turned off, wherein the controller comprises:

a pump output command value storage section for storing a pump output command value for an instruction on an output level of the micropump;

a bit pattern conversion section for converting the pump output command value in the pump output command value storage section to a bit pattern corresponding to the pulse train pattern of the control pulse signal and outputting the bit pattern; and a control pulse signal generation section for generating the control pulse signal based on the bit pattern output from the bit pattern conversion section, wherein the pump output command value storage section is configured so that the pump output command value stored therein can be rewritten during or before operation of the micropump, wherein the micropump device includes a plurality of the micropumps, and the controller is configured to supply a plurality of control pulse signals to respective individual light sources of the plurality or micropumps, wherein the controller further comprises:

a pump output command value storage section for storing a plurality of pump output command values for respective individual instructions on respective output levels of the micropumps;

a bit pattern conversion section for converting the plurality of pump output command values in the pump output command value storage section to the same plurality of respective individual bit patterns corresponding to respective pulse train patterns of respective control pulse signals for the micropumps and outputting the plurality of bit patterns;

a serial data generation section for serially outputting sets of bit data, each set of bit data constituting one of the respective bit patterns for the micropumps output from the bit pattern conversion section; and a control pulse signal generation section for generating the respective control pulse signals for the micropumps in parallel based on the sets of bit data output from the serial data generation section and outputting the control pulse signals in parallel.

3. The micropump device of claim 2, wherein the controller further comprises a command interpreter for interpreting a command sequence given from the outside and rewriting the plurality of pump output command values in the pump output command value storage section during or before operation of the micropumps.

4. The micropump device of claim 2, wherein the controller further comprises:

a command interpreter for interpreting a command sequence given from the outside and generating a plurality of pieces of event information each formed of a set of a pump number, a pump output command value and a scheduled execution time;

an event information storage section for storing the plurality of pieces of event information;

a timer for counting the time;

a prefetch section for retrieving the plurality of pieces of event information from the event information storage section prior to execution of the pieces of event information; and an event management section for comparing the scheduled execution times in the pieces of event information retrieved into the prefetch section with the time of the timer and, if there is a piece of event information the scheduled execution time for which has come, giving the pump output command value for the pump number in that piece of event information to the pump output command value storage section to rewrite the pump output command value for the corresponding pump number in the pump output command value storage section.

5. A micropump device comprising:

(a) a micropump including a microchannel serving as a channel for liquid, a gas generating material generating a gas upon exposure to light and supplying the gas to the microchannel, and a light source for irradiating the gas generating material with light; and (b) a controller for supplying a control pulse signal to the light source, the control pulse signal causing the light source to blink on and off in a binary manner by repeating a pulse train pattern composed of a fixed number of bits each capable of having two states one of which is a first level allowing the light source to be turned on and the other of which is a second level allowing the light source to be turned off, wherein the controller comprises:

a pump output command value storage section for storing a pump output command value for an instruction on an output level of the micropump;

a bit pattern conversion section for converting the pump output command value in the pump output command value storage section to a bit pattern corresponding to the pulse train pattern of the control pulse signal and outputting the bit pattern; and a control pulse signal generation section for generating the control pulse signal based on the bit pattern output from the bit pattern conversion section, wherein the pump output command value storage section is configured so that the pump output command value stored therein can be rewritten during or before operation of the micropump, wherein the micropump device includes a plurality of the micropumps, and the controller is configured to supply a plurality of control pulse signals to respective individual light sources of the plurality of micropumps, wherein the controller further comprises:

a pump output command value storage section for storing a plurality of pump output command values for respective individual instructions on respective output levels of the micropumps;

a clock signal generation section for generating a clock signal for synchronization with serial transmission of bit data;

a latch signal generation section for generating a latch signal each time the periods of the clock signal are counted to the number of the micropumps;

a bit pattern conversion section for sequentially retrieving the pump output command values in the pump output command value storage section one by one in timed relation to the clock signal, sequentially converting the pump output command values to individual bit patterns corresponding to the respective pulse train patterns of the respective control pulse signals for the micropumps and sequentially outputting the bit patterns;

a bit pattern register for storing the bit pattern for one pump output command value just output from the bit pattern conversion section;

a bit selector for retrieving one bit of bit data from the bit pattern in the bit pattern register in timed relation to each period of the clock signal and shifting the position of the bit pattern at which one bit of bit data is to be retrieved from digit to digit according to the latch signal, thereby outputting sets of bit data as respective serial bit patterns, each set of bit data being composed of bits of the same digit in the plurality of bit patterns for the plurality of micropumps;

three transmission channels, one transmission channel for transmitting the serial bit patterns output from the bit selector, another transmission channel for transmitting the clock signal output from the clock signal generation section and the other transmission channel for transmitting the latch signal output from the latch signal generation section; and a control pulse signal generation section that includes a shift register for taking the serial bit patterns, the clock signal and the latch signal sent via the three transmission channels, generates the respective control pulse signals for the micropumps in parallel based on the serial bit patterns, and outputs the control pulse signals in parallel.

6. The micropump device of claim 5, wherein the controller further comprises a command interpreter for interpreting a command sequence given from the outside and rewriting the plurality of pump output command values in the pump output command value storage section during or before operation of the micropumps.

7. The micropump device of claim 5, wherein the controller further comprises:

a command interpreter for interpreting a command sequence given from the outside and generating a plurality of pieces of event information each formed of a set of a pump number, a pump output command value and a scheduled execution time;

an event information storage section for storing the plurality of pieces of event information;

a timer for counting the time;

a prefetch section for retrieving the plurality of pieces of event information from the event information storage section prior to execution of the pieces of event information; and an event management section for comparing the scheduled execution times in the pieces of event information retrieved into the prefetch section with the time of the timer and, if there is a piece of event information the scheduled execution time for which has come, giving the pump output command value for the pump number in that piece of event information to the pump output command value storage section to rewrite the pump output command value for the corresponding pump number in the pump output command value storage section.

* * * * *